US007937860B2

(12) United States Patent
Wightman

(10) Patent No.: US 7,937,860 B2
(45) Date of Patent: May 10, 2011

(54) CALENDAR

(76) Inventor: Paul Wightman, Cedar City, UT (US)

( * ) Notice: Subject to any disclaimer, the term of this patent is extended or adjusted under 35 U.S.C. 154(b) by 20 days.

(21) Appl. No.: 12/386,237

(22) Filed: Apr. 14, 2009

(65) Prior Publication Data

US 2010/0018089 A1 Jan. 28, 2010

Related U.S. Application Data

(63) Continuation-in-part of application No. 11/890,917, filed on Aug. 7, 2007, now Pat. No. 7,516,568.

(60) Provisional application No. 60/835,949, filed on Aug. 7, 2006.

(51) Int. Cl.
*G09D 3/00* (2006.01)

(52) U.S. Cl. ..... 40/107; 273/139

(58) Field of Classification Search ..... 40/107; 283/2–4; 206/531, 532, 534
See application file for complete search history.

(56) References Cited

U.S. PATENT DOCUMENTS

| | | | | | |
|---|---|---|---|---|---|
| 780,086 | A * | 1/1905 | Brewer | 273/139 |
| 1,520,648 | A * | 12/1924 | Holt | 40/107 |
| 2,301,970 | A * | 11/1942 | Rau | 273/139 |
| 2,310,574 | A * | 2/1943 | Cartwright | 273/139 |
| 2,831,278 | A * | 4/1958 | Myers | 40/107 |
| 2,914,871 | A * | 12/1959 | Smith et al. | 40/107 |
| 3,290,812 | A * | 12/1966 | Hunkins | 40/107 |
| 4,472,894 | A * | 9/1984 | Wightman | 40/107 |
| 5,974,032 | A * | 10/1999 | Snowden et al. | 370/316 |
| 7,090,253 | B2 * | 8/2006 | Phillips et al. | 283/2 |
| 7,401,702 | B2 * | 7/2008 | Hession | 206/531 |

* cited by examiner

*Primary Examiner* — Joanne Silbermann
*Assistant Examiner* — Shin Kim
(74) *Attorney, Agent, or Firm* — TraskBritt

(57) ABSTRACT

A dispensing device, such as a calendar is formed of a plurality of substrates. A first substrate carries indicia thereon which identifies selected time periods, such as days or months of the year. A second substrate is positioned adjacent to the first substrate. The second substrate defines a plurality of cavities dimensioned to individually retain a respective information carrying article, such as a web. Each of the cavities is corresponding supplied with a respective information carrying article. Each indicia on the first substrate is positionally associated with a respective cavity in the second substrate. A third substrate, positioned adjacent to the second substrate, is positioned to retain the information carrying articles releasably within the second substrate. The third substrate provides a rupturable cover over each of the cavities of the second substrate whereby upon the application of a sufficient lateral force on the information carrying article within a selected cavity, the article passes through the cover to a location wherein the article may be retrieved by the user. The lateral force may be applied by the user's finger or alternatively a tool or other object adapted for the application of such force.

19 Claims, 27 Drawing Sheets

*FIG. 1*

CALENDAR

CROSS-REFERENCE TO RELATED APPLICATION

This application is a continuation-in-part application of U.S. application Ser. No. 11/890,917 filed 7 Aug. 2007, now U.S. Pat. No.7,516,568, which claims the benefit under 35 U.S.C. §119(e) of U.S. Provisional Application No. 60/835,949, filed 7 Aug. 2006, Both of these prior applications are hereby incorporated in their entireties by reference.

FIELD OF INVENTION

This invention relates to structures for identifying the various days of the year, e.g., calendars. More particularly, the invention is directed to a calendar that not only provides an identification of the various days of the year, but furthermore, may be used to provide information, entertainment, education or other benefits, especially on a daily basis.

BACKGROUND

Calendars, as a traditional method of identifying the arrangement of days and months of a year, are well known. Such calendars have heretofore been configured in various forms and constructions. In the most conventional presentation, a calendar includes a planar substrate having an indication thereon of the twelve months, which together constitute the traditional year. A grouping of the various days, which together constitute an individual month, may also be indicated. Oftentimes, calendars adopt a configuration whereby each day is associated with a respective day of the week, e.g., a Wednesday.

Calendars provide the user with a means of readily identifying a specific day as well as the day of the week, month and or year associated with that day. While the information previously provided by traditional calendars is very helpful to the user, it has been previously recognized that calendars may be utilized to provide a user with other utility beyond that historically associated with traditional calendars. Representative efforts in this regard are disclosed in U.S. Pat. No. 780,086 (Brewer et al.); U.S. Pat. No. 1,520,648 (Holt); U.S. Pat. No. 2,301,970 (Rau); U.S. Pat. No. 2,831,278 (Myers); U.S. Pat. No. 2,914,871 (Smith et al.); and U.S. Pat. No. 3,290,812 (Hunkins).

An interesting development in the calendar art was the calendar construction disclosed in U.S. Pat. No. 4,472,894 (Wightman). This particular calendar construction provided a traditional first substrate having the conventional calendar indicia disposed on an outer surface thereof. The outer substrate was associated with a secondary substrate having a plurality of elongate channels formed therein. The longitudinal axis of each of these channels was oriented perpendicular to the surface of the outer substrate. A third substrate, formed by a thin sheet of paper, was positioned adjacent to the second substrate whereby the elongate channel was sealed on each of its opposing ends, i.e., the first end of the channel being sealed by the outer substrate while the second opposing end was sealed by the third substrate. Positioned within each of these elongate channels is a respective paper roll having a message printed thereon such as a horoscope, quotation, riddle or other information. Each of the elongate channels was associated with a respective day of the calendar whereby the user could punch through the outer substrate and thereafter displace the paper roll through the third substrate and thereby cause the paper roll to be displaced outwardly from the third substrate.

A channeling structure was positioned proximate the back surface of the third substrate for directing the dislodged paper roll to a collection tray positioned below the assembly of the three substrates.

While the '894 calendar structure provides a number of interesting benefits, it is also limited in its usefulness due to the nature of its construction. For example, the orientation of the elongate channels, perpendicular to the planar surface of the first substrate, requires the calendar to have a considerable thickness. This thickness requirement severely limits the environments wherein this particular type of calendar can be employed. For example, this thickness requirement may limit the manufacture of smaller versions of the calendar, e.g., a desk top version. Furthermore, the '894 calendar requires the user to utilize a tool in order to operate the calendar. This tool is easily misplaced thereby rendering the calendar inoperative.

There continues to exist a need for a calendar construction that at once provides the user with the information conveyed by a conventional calendar while also permitting the user to be supplied with a daily informational or entertainment article that may be used in environments that are spatially constrained.

SUMMARY OF THE INVENTION

A calendar of the invention is formed of a plurality of substrates that are associated one with another to form an assembly that defines a series of indicia identifying the various days of a time period, e.g., a calendar month. The substrates form a structure for retaining a plurality of articles to be dispensed from the calendar and a further structure that facilitates the orderly dispensing of those articles. The dispensing of the articles is typically associated with individual days of the calendar. In one embodiment, a series of voids or retaining channels are defined within one or more of the substrates. These voids may be positioned behind the indicia. Applying a force to the indicia or in the vicinity of the indicia results in the article, positioned behind the indicia, being discharged. A passageway is defined within the assembly that leads from the voids to a centralized collection location. The indicia may be disposed on a flexible sheet of material that is displaceable by the user whereby upon the application of a sufficient force on the indicia, the flexible sheet is displaced against an article retained within a respective void positioned behind the flexible sheet thereby causing the article to be dislodged from the void into the passageway and thereafter to the collection location. One or more of the voids or retaining channels is elongate in configuration and defines a longitudinal axis that is oriented parallel with the plane of the front surface of the calendar or alternatively with the substrate that defines the void. This orientation of the longitudinal axis facilitates the retention of an article within the void. The void has a length that may be considerably longer dimensionally than the thickness of the assembly. A longitudinal axis of the article is positioned parallel to the longitudinal axis of the void in which it is positioned.

DETAILED DESCRIPTION OF THE INVENTION

The instant invention is described herein by reference to a calendar which incorporates the structural elements of the invention. It should be understood that the invention is directed principally to a structure and method for distributing articles. It follows that structures adapted for distributing articles, other than the calendar described herein, may also incorporate the invention. The following description is therefore not intended to be restrictive of the structure of the invention or its use and method of operation.

Figure 1:
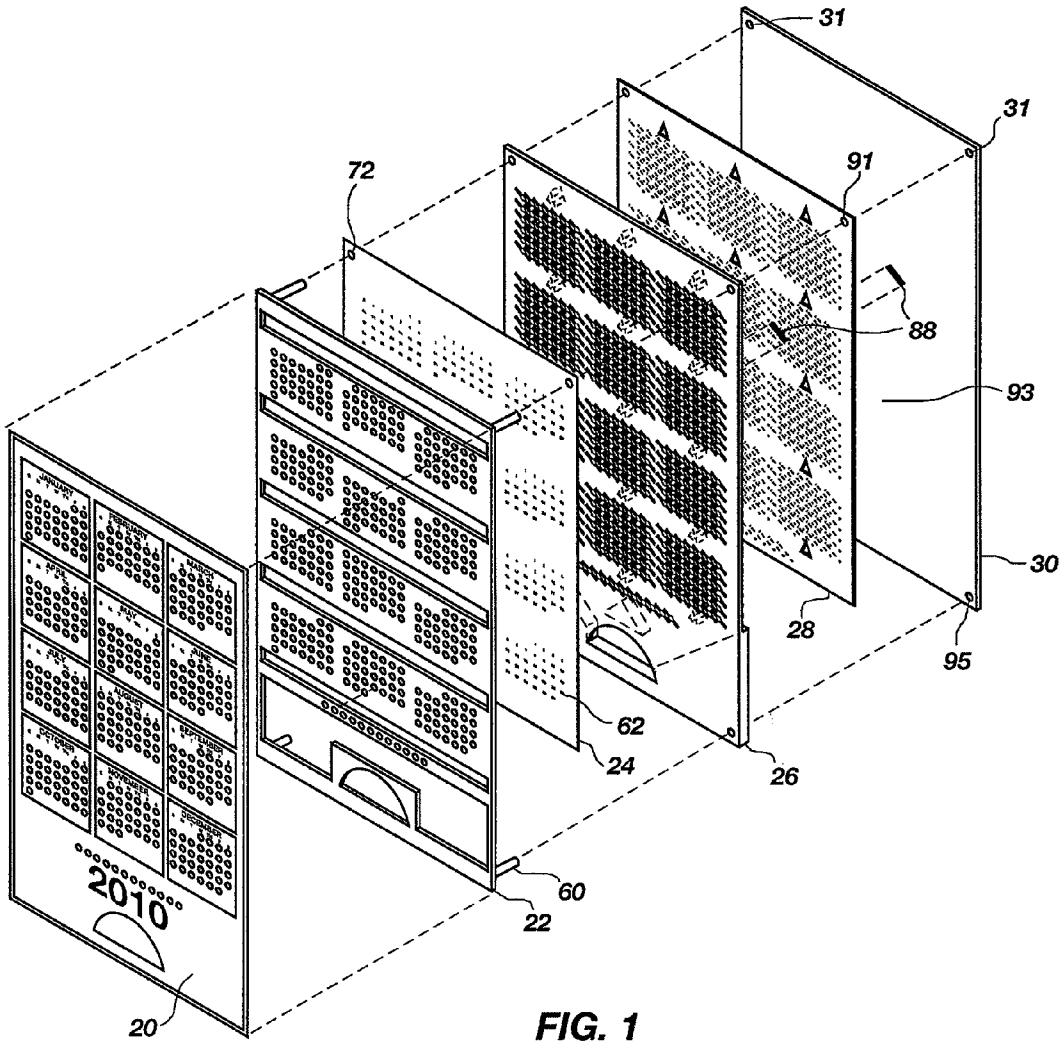
FIG. 1 is an exploded perspective view of a calendar in accordance with the instant invention.
Figure 2:
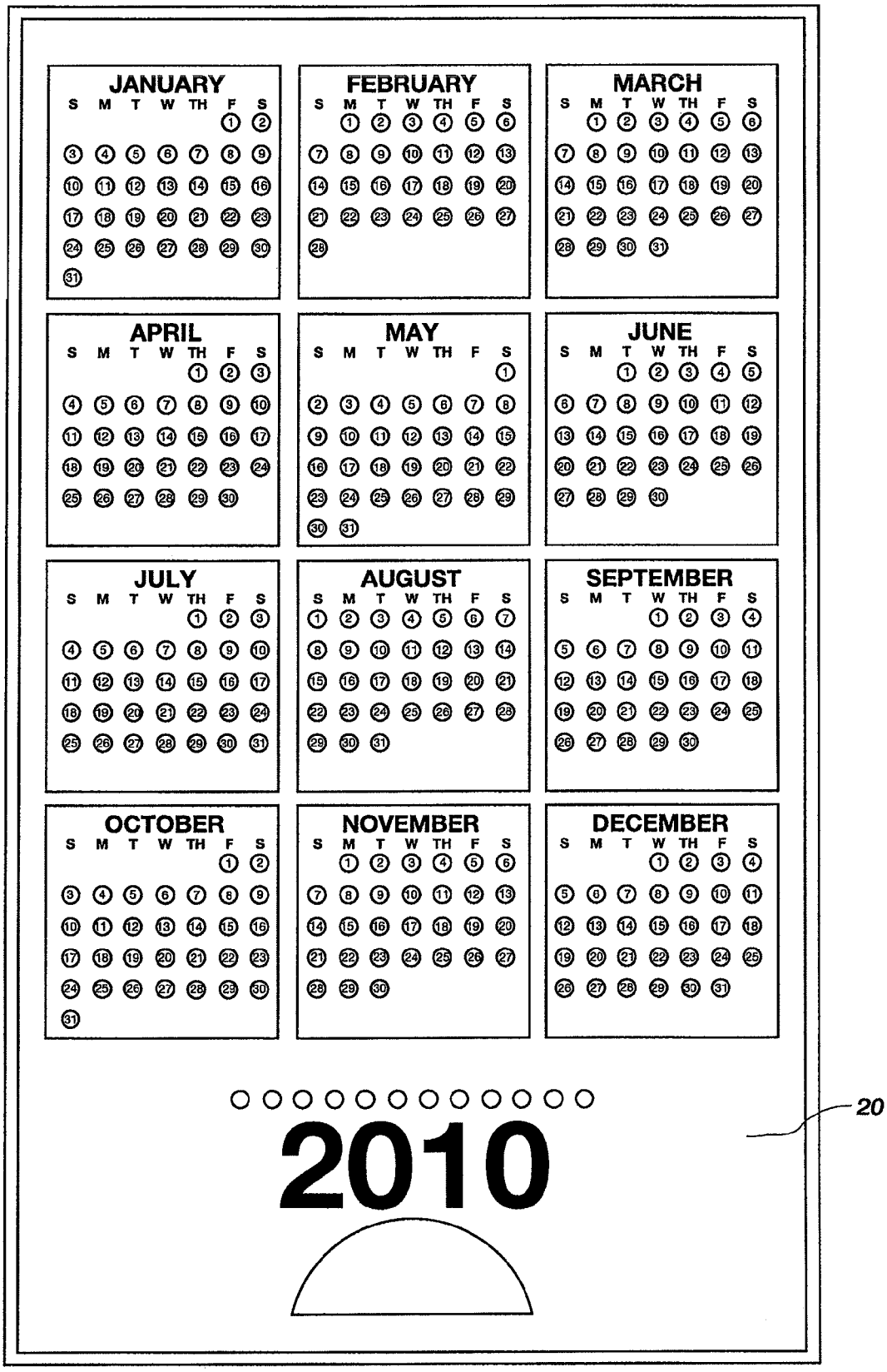
FIG. 2 is a front elevational view of the calendar assembly illustrated in FIG. 1.
Figure 17:
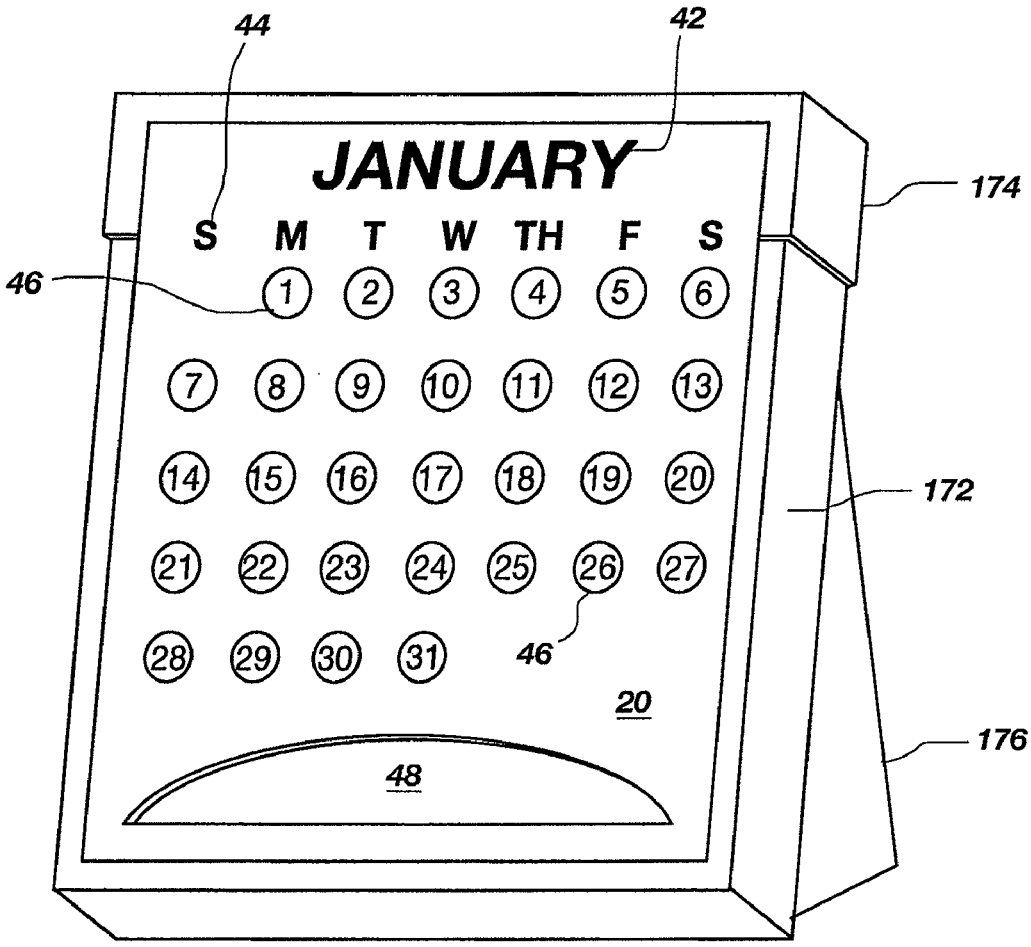
FIG. 17 is an alternate perspective view of a calendar assembly of the instant invention.

As shown in FIG. 1, a calendar of the instant construction may include six substantially planar substrate panels 20, 22, 24, 26, 28 and 30, each having a generally rectangular configuration. It should be understood that while FIG. 1 illustrates the various panels as having a rectangular configuration, alternative configurations may also be utilized in the invention, e.g., circular, oval, etc. Alternative constructions may include less than six panels, e.g., three panels. The association of six substrates may be housed within a cabinet structure configured to retain the substrates in a generally fixed orientation. In preferred constructions the panels are positioned generally upright and parallel to one another. An illustrative cabinet structure is shown in FIG. 17. Alternative cabinet or frame structures may include a simple frame positioned about the assembly of substrates. Each substrate has a planar front face and a planar rear face and four linearly configured sides. The material composition of each substrate may vary based on the specific function that the particular substrate is intended to perform.

Figure 3:
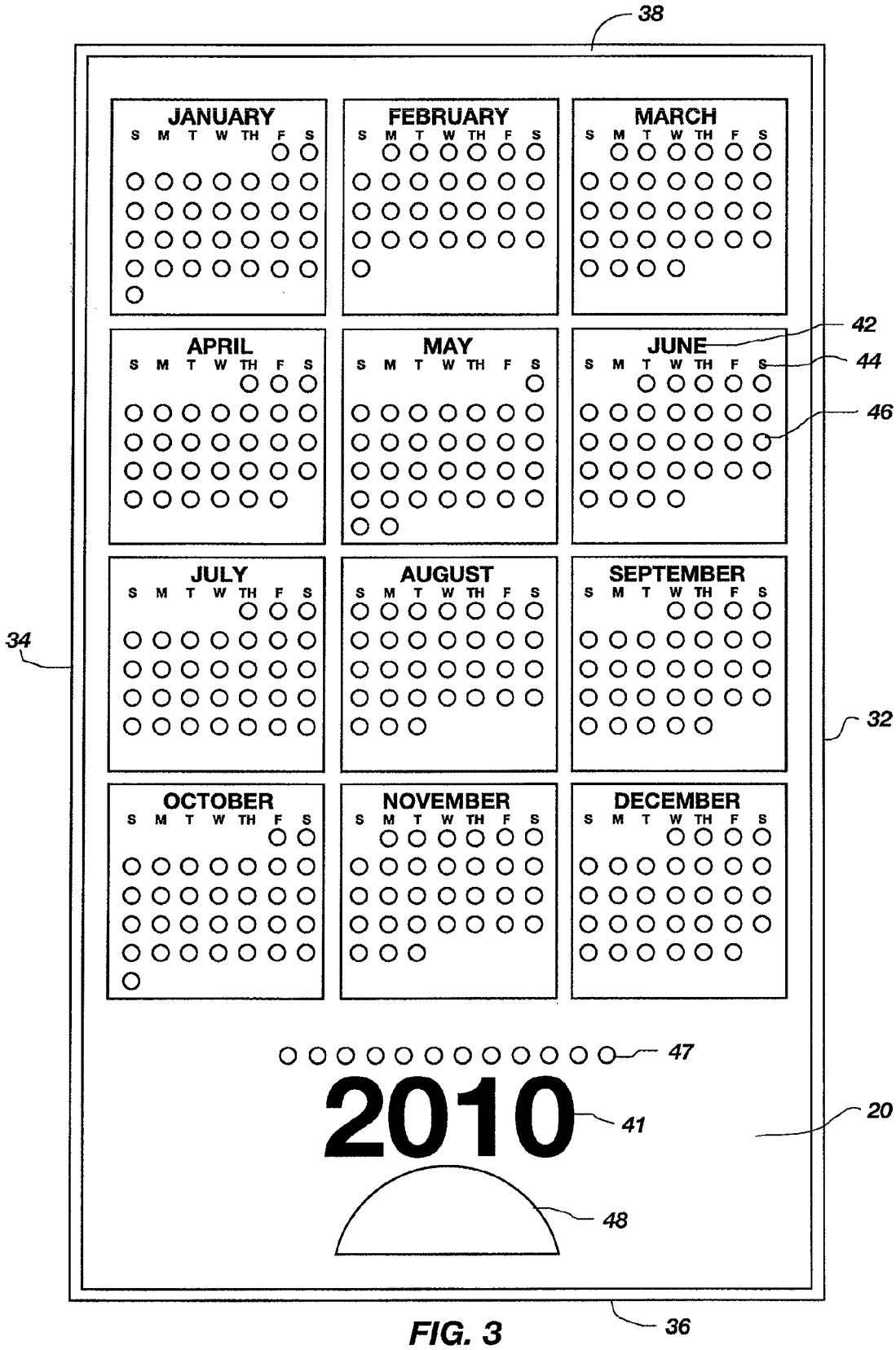
FIG. 3 is a front elevational view of the first substrate of the calendar assembly illustrated in FIG. 1.

The first substrate 20, as shown in greater detail in FIG. 3, may be formed of paper, plastic or other suitable material that is amenable to having printing applied to the surface thereof. The first substrate 20 has a bottom linear edge 36, two upstanding linear edges 32 and 34 and a top linear edge 38. As illustrated, the first substrate 20 may include a depiction thereon of one or more months in a traditional calendar arrangement. The name of the month 42, e.g., June, is identified at the upper region of the representation of each month. Positioned elevationally below the name of the month, in a horizontal array, is a letter 44 or other indication of the seven days of the traditional week. Positioned below the indications of the days is a plurality of circular openings 46 that are disposed in linear arrays of horizontal and vertical rows. Each of the days of the month is associated with a respective circular opening 46. The opening 46 extends through the entire thickness of the substrate 20. In the embodiment of the invention shown in FIG. 3, the representations of the months are themselves arranged in linear arrays, both horizontally and vertically.

The first substrate 20 may further include an indication of the year 41, e.g., 2010, as well as a series of auxiliary openings 47 positioned above the indication of the year, which also may be formed of a series of circular openings that extend through the complete thickness of the first substrate 20. Positioned near the lower edge 36 of the first substrate 20 is a large opening 48. This opening 48 also extends through the entire thickness of the substrate 20 and is dimensioned to permit a user to reach therein and collect an article, e.g., an entertainment message, deposited therein by the operation of the calendar.

Figure 4:
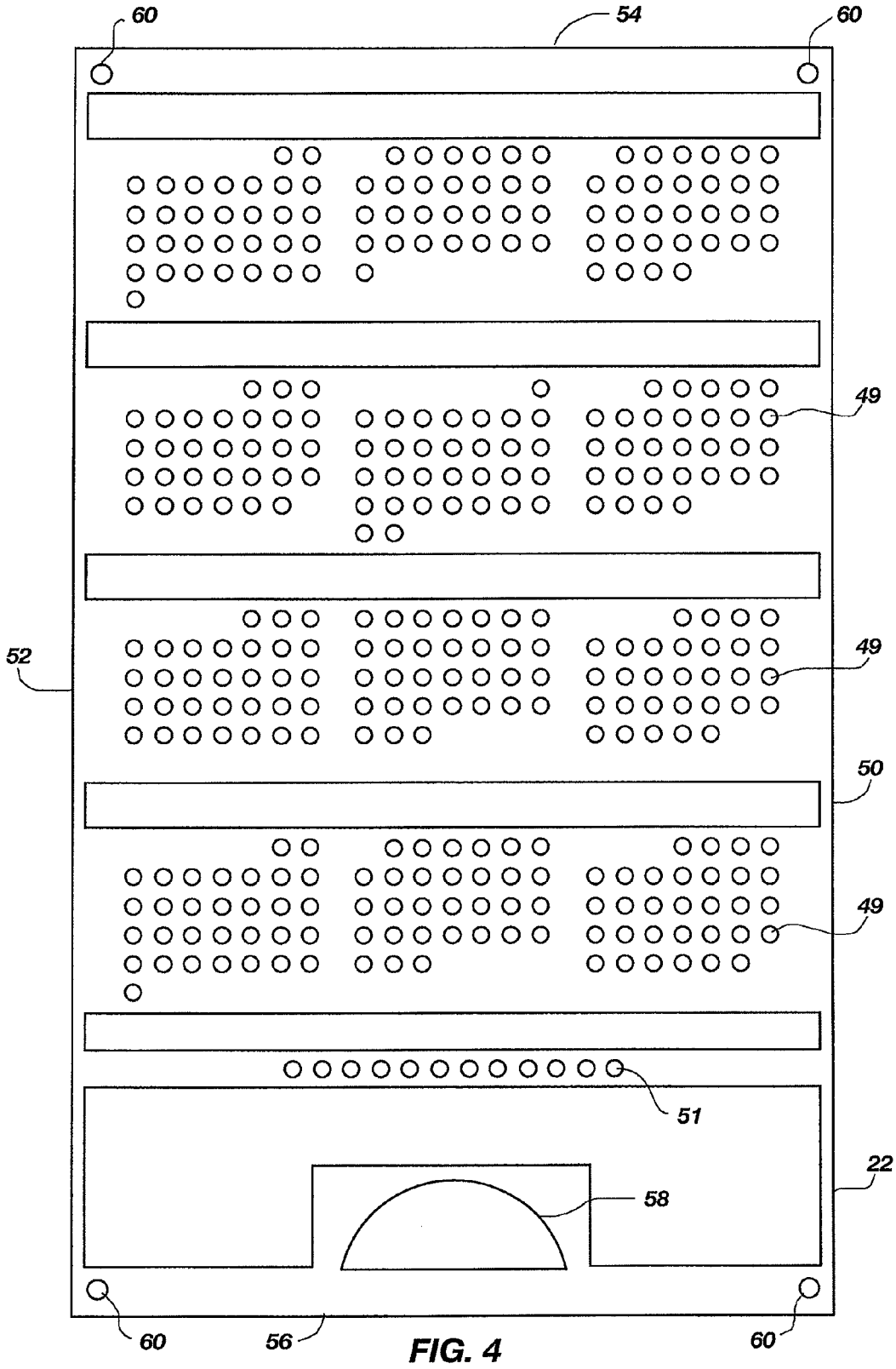
FIG. 4 is a front elevational view of the second substrate of the calendar assembly illustrated in FIG. 1.

The first substrate 20 is adhered or otherwise secured to the outer face of the second substrate 22. The second substrate, shown in FIG. 4, is a planar panel having an upper edge 54, two upstanding linear edges 50 and 52 and a linear bottom edge 56. The second substrate 22 is similar to the first substrate 20 in that it defines a plurality of circular openings 49 that extend through the entire thickness of the second substrate 22. These openings 49 are arranged similar to the arrangement of the circular openings 46 in the first substrate 20, i.e., in linear horizontal and vertical rows. The circular openings 49 are arranged to align with the circular openings 46 of the first substrate 20 when the two substrates are secured to one another.

It follows that when the two substrates are associated one to the other, each circular opening 46 is paired with a corresponding circular opening 49 to form a continuous channel that extends through the combined thickness of the two secured substrates 20 and 22. The second substrate 22 may also define a series of circular openings 51 that correspond to the circular openings 47 of the first substrate 20. Similarly, a large opening 58 is defined in the lower portion of the second substrate, proximate the lower edge 56, that corresponds both dimensionally and positionally to the opening 48 of the first substrate 20. The second substrate 22 is formed of a substantially rigid material that provides sufficient rigidity to the assembly to maintain the assembly substantially resistant to the forces applied thereto by a user who is engaged in pushing a dislodgement tool through the respective slots 130 that are positioned about the respective openings 46 and 49.

In those embodiments of the invention wherein the calendar is operated by the user using his or her finger instead of a dislodgement tool, the second substrate is sufficiently rigid to resist the forces directed against the calendar structure by the user's pushing on that portion 61 of the third substrate 24 that extends through openings 46 and 49, which identify the various days of the calendar.

Secured to the back face of the second substrate 22 is a plurality of spacer elements 60. As shown, these elements may be positioned proximate the four corners of the second substrate 22. These spacer elements 60 are dimensioned to pass through openings defined in the subsequently positioned three substrates 24, 26, and 28 and thereafter engage the sixth substrate 30 thereby defining a selected spacing of the fifth substrate 28 from the sixth substrate 30 sufficient to define a channel 150 (see FIG. 11). As shown, these spacer elements 60 may be formed of elongate cylindrical members that are secured on their first ends to the back face of the second substrate 22 and whose opposing ends engage respective receiving wells 31 defined in the sixth substrate 30.

Figure 5:
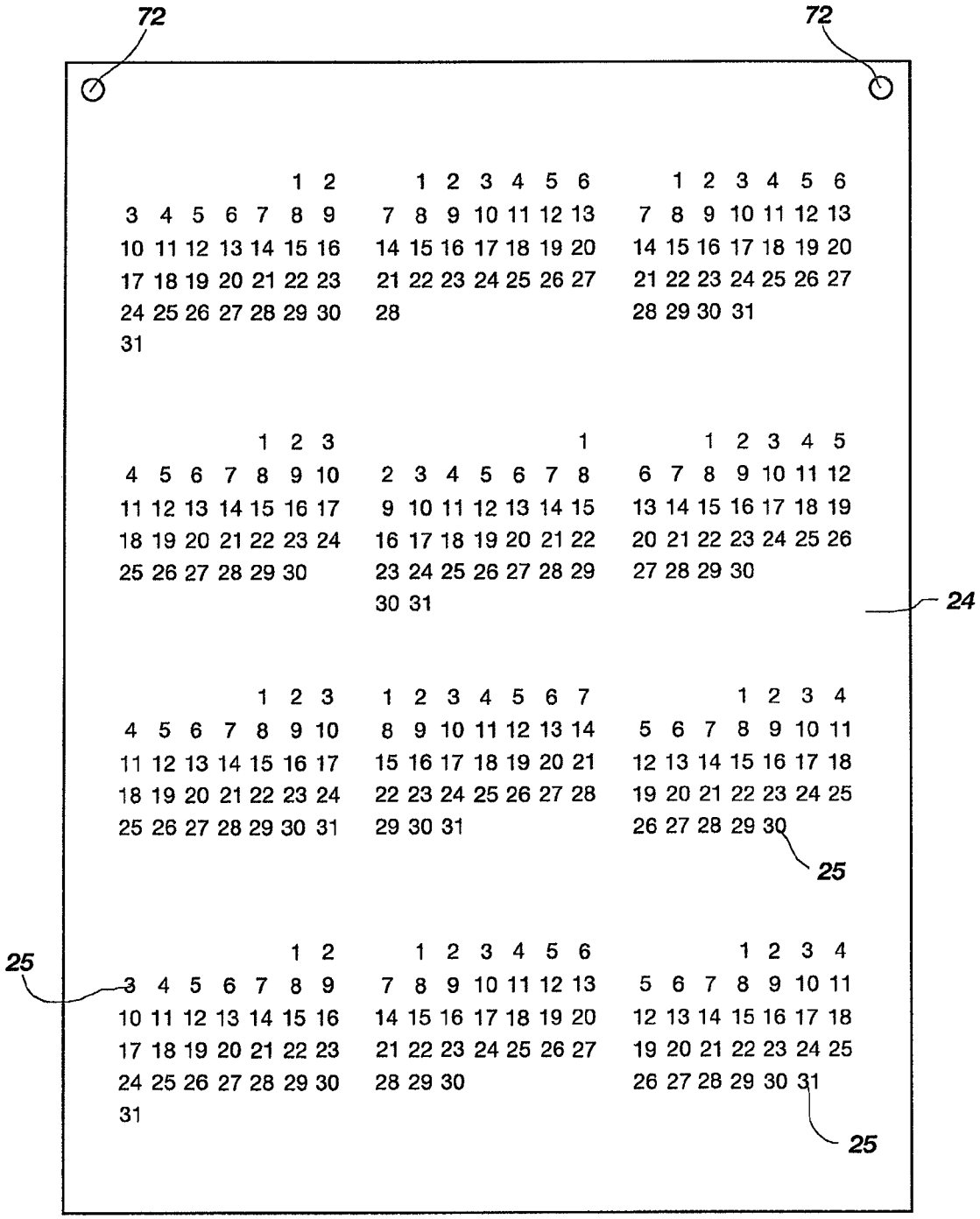
FIG. 5 is a front elevational view of the third substrate shown in FIG. 1.

The third substrate 24, as shown in FIG. 5, is formed of a thin rectangular sheet, which may be fabricated from a metal foil, plastic sheet, or other flexible material.

In other embodiments, the third substrate may be formed of thermoformed plastic or a silicone membrane. Alternative materials exhibiting similar characteristics to these materials may also be utilized. The front face of the third substrate includes a plurality of indicia, such as numbers 25, printed therein. The numbers 25 are arranged in linear arrays that are arranged both vertically and horizontally. Each of the numbers is positioned so as to align with a respective circular opening 46 and 49 of the two previously described substrates 20 and 22 when the three substrates are positioned adjacent one another. Furthermore the numbers 25 are dimensioned such that upon assembly of the calendar each of the numbers 25 is clearly visible through its respective circular opening defined by opening 46 and 49.

Figure 12:
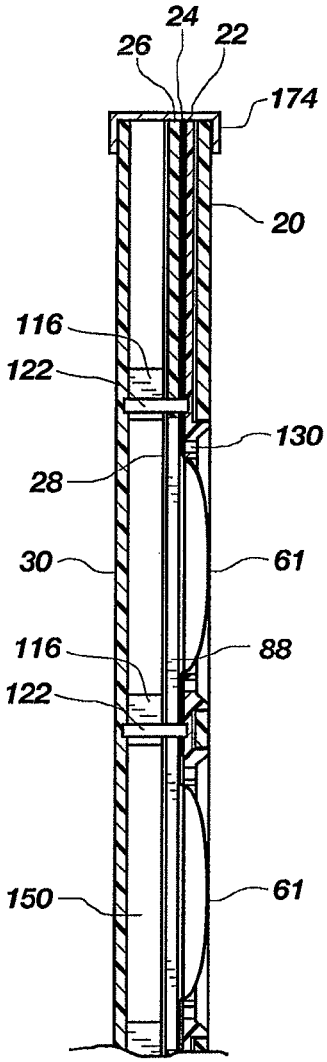
FIG. 12 is a cross-sectional view of the Calendar of FIG. 1 with a top cabinet structure positioned thereon.
Figure 12A:
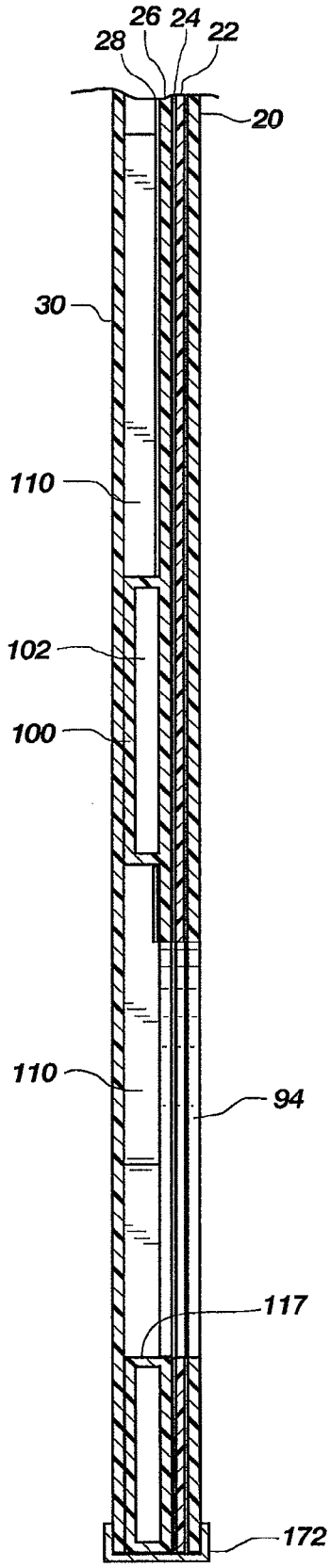
FIG. 12A is a continuation of the cross-sectional view of FIG. 12.

In a preferred construction, the front face of this substrate 24 is secured to the rear face of the second substrate 22 whereby the sheet extends through each of the openings 46 and 49 to form a semi-spherical configuration 61 as shown in FIG. 12. This configuration may be produced by applying a vacuum to the outer face of the first substrate 20 during the assembly process either during or subsequent to the assembly of the first three substrates.

As can be seen in FIG. 1, the third substrate 24 is dimensioned to have a height that is less than the first two substrates. When the third substrate is secured to the back face of the second substrate 22 the lower edge of the third substrate is positioned at a location slightly below the horizontal array of circular openings 51 thereby leaving the lower portion of the back face of the second substrate 22 exposed. The third substrate may be adhered to the back surface of the second substrate using a conventional adhesive.

Figure 6:
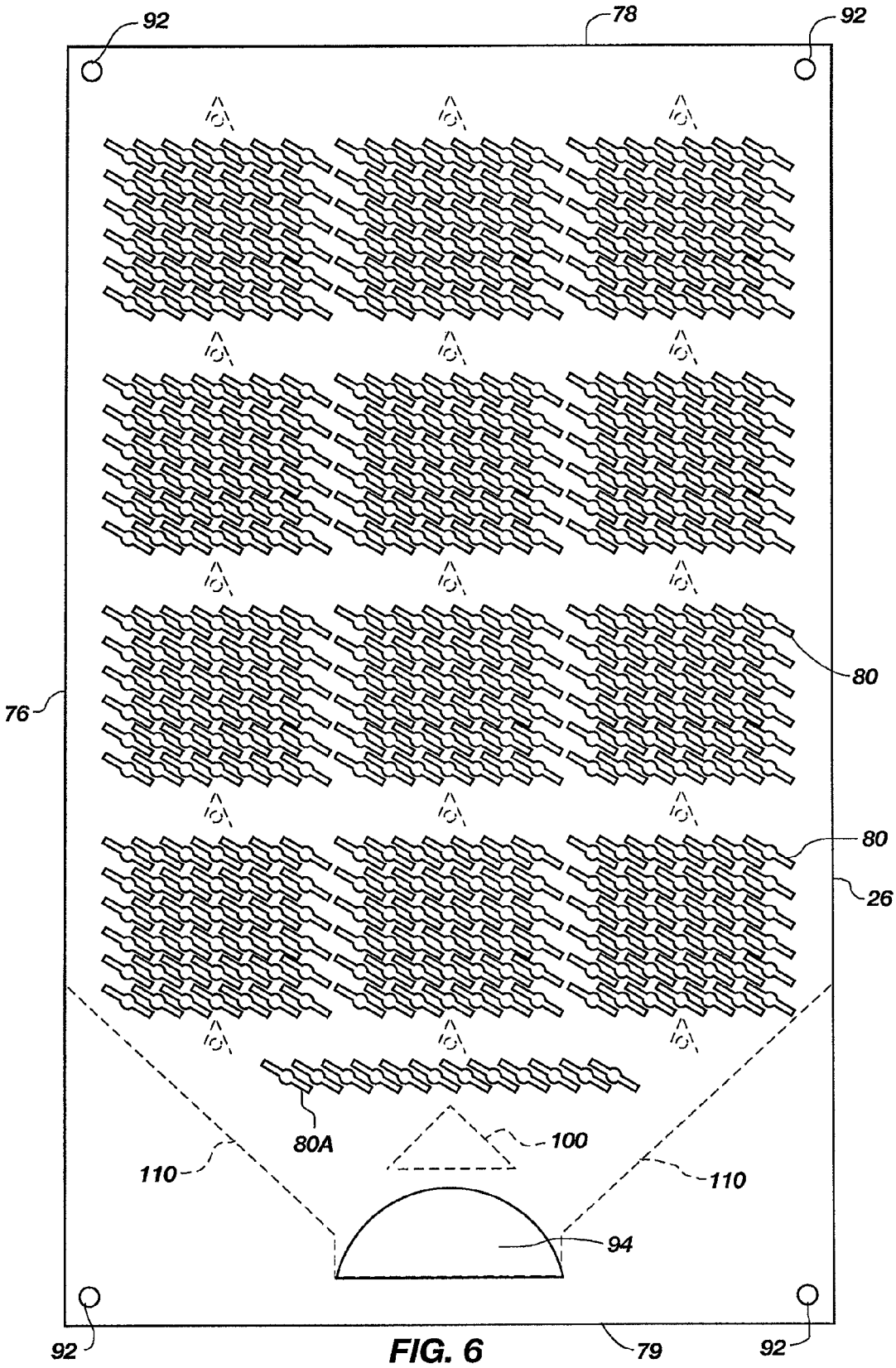
FIG. 6 is a front elevational view of the fourth substrate shown in FIG. 1.
Figure 9:
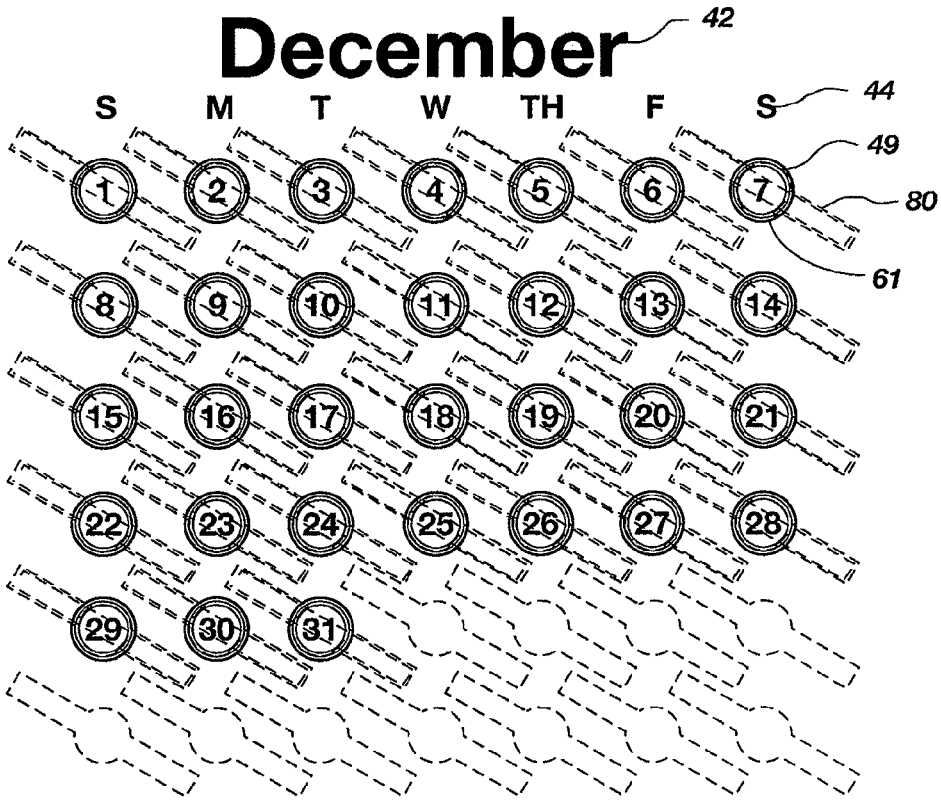
FIG. 9 is a sectional view of the calendar of FIG. 1.
Figure 9A:
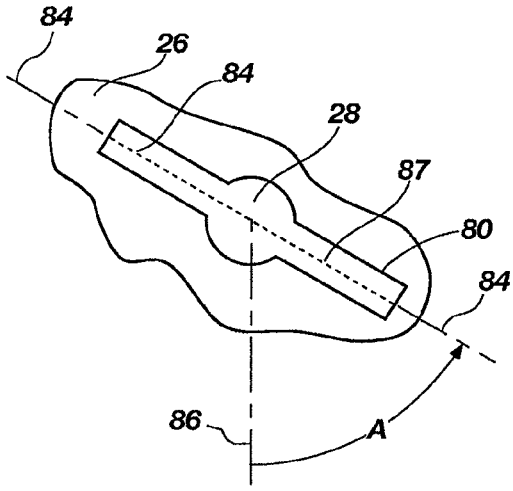
FIG. 9A is a sectional front view of the fourth and fifth substrates shown in FIG. 1.
Figure 9B:
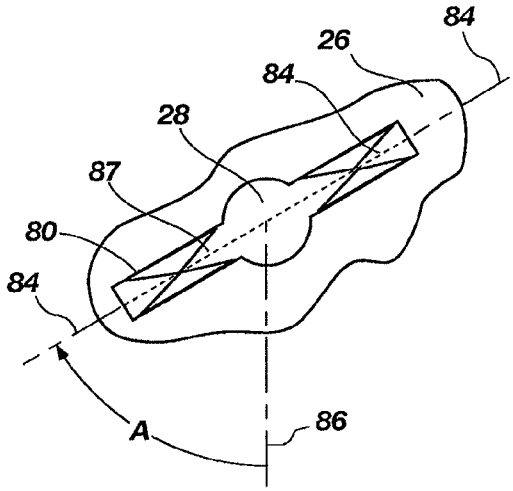
FIG. 9B is a sectional front view an alternative embodiment of the fourth and fifth substrates shown in FIG. 1.

As shown in FIG. 6, the fourth substrate 26 defines a plurality of openings or cavities 80 therein that may be viewed as being formed of an elongated rectangular opening in association with a circular opening positioned proximate the center of the rectangular opening. Each of the openings 80 is dimensioned to receive and releasably retain an article to be dispensed. In the presently described embodiments of the invention this article is depicted as a message strip 88 which is folded to form a compacted web. It should be appreciated that other articles may also be dispensed using the instant invention. For example, coupons, pills, small toys, candy or other articles may be placed in the openings 80 and subsequently dispensed. Notably, the openings are sized to accommodate the article to be dispensed. Each of these openings 80 defines a longitudinal axis 84 that is oriented at an angle A to the vertical 86, as shown to advantage in FIG. 9A. This angle A is defined clockwise from the vertical as shown in FIG. 9A. Preferably, the angle A is approximately 30 degrees, however, the angle may be any degree measure within the range of 5 degrees to 85 degrees. A preferred range is 15 to 60 degrees with a very preferred range being between 15 and 45 degrees. FIG. 9B shows an alternative embodiment of the invention, wherein the orientation of the opening 80 has been shifted by 90 degrees. In this embodiment, the angle A is defined counterclockwise from the vertical. In this alternative embodiment, the angle A may likewise be preferably 30 degrees. The preferred ranges identified for the embodiment of FIG. 9A are equally applicable to the embodiment shown in FIG. 9B. The openings 80 are arranged in linear arrays of horizontal rows and vertical rows to form the various groupings shown in FIG. 6. Each of the openings 80 is configured and positioned to align with a respective association of an opening 46 and an opening 49 in the first 20 and second substrate 22.

Figure 9C:
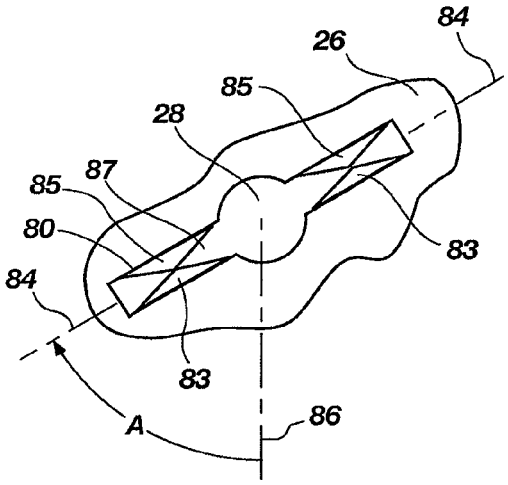
FIG. 9C is a sectional front view of yet another alternative embodiment of the fourth substrate shown in FIG. 1.

FIG. 9C illustrates an embodiment wherein an article retaining structure includes two triangle shaped retaining elements 83 and 85. Each retaining element extends from a longitudinal edge of the cavity 80 toward a longitudinal axis 84 of the cavity 80. The two retaining elements 83 and 85 may engage one another at their apexes proximate their intersection with the longitudinal axis 84. The retaining elements 83 and 85 provide a sufficient retaining force against an article disposed within the cavity 80 to retain that article in place within the cavity absent the application of a force to that article of sufficient magnitude to overcome the resistance offered by the retaining elements. In a preferred construction, these retaining elements 83 and 85 are constructed of paper. When a force is applied to an article residing in the cavity 80 resulting from a user pushing or depressing the button 61, a laterally directed force is applied to the article. This in turn causes the article to be displaced outwardly through the retaining elements 83 and 85. In this event, the two retaining elements essentially pivot or twist about their mounting to the longitudinal edges of the cavity. The two apexes of the triangular elements are pushed outward away from each other and the article passes through the retaining elements. As shown a pair of retaining elements 83 and 85 may be located on either side of the circular opening of the cavity 80.

The orientation of the openings 80 such that their longitudinal axes are positioned parallel to the surface of the substrate 26 facilitates the construction of a calendar that is markedly reduced in thickness. In prior calendar constructions wherein the article to be dispensed was oriented perpendicular to the surface of the calendar, the thickness of the calendar often exceeded 4¼ inches. This assumes an article length of approximately 2 inches. In the instant invention, with the article 88 oriented essentially parallel to the surface of the calendar, the thickness can be reduced to approximately ¾ inch while dispensing the same length article, resulting in a calendar thickness reduction of almost 83%. This reduction permits the construction of calendars having greater usefulness.

Figure 7:
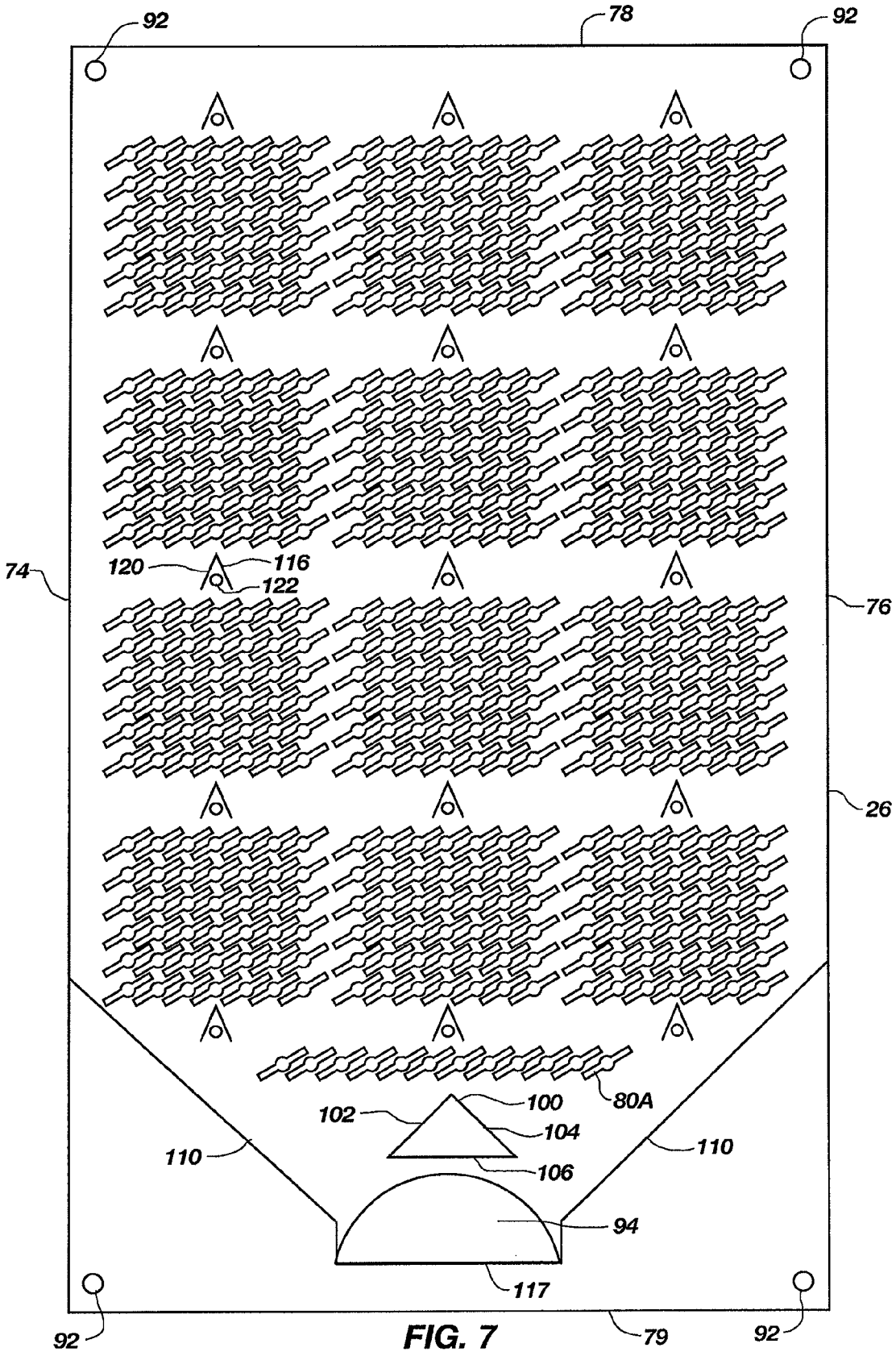
FIG. 7 is a rear elevational view of the fourth substrate shown in FIG. 1.

FIG. 7 illustrates the rear surface of the fourth substrate 26. As shown, the substrate defines an upper linear edge 78, two upstanding linear edges 74 and 76 and a linear bottom edge 79. The corners of the substrate 26 define an opening 92 that is dimensioned to receive a respective spacer 60. A plurality of guide members 116 are shown positioned on the rear surface of the substrate 26 to extend outwardly away from the rear surface of the substrate, Each guide member and support 116 may be formed of an inverted "V"-shaped element 120 in association with a cylindrical element 122 that is adhered on its first end to the rear surface of the substrate 26. In alternative constructions the element 116 may be configured differently. For example, the element 116 may be configured solely as a cylindrical element 122.

Each of the guide and support members 116 is positioned proximate a respective grouping of openings 80 and functions to direct articles that are dislodged from those respective openings downwardly to the collection opening 94. A triangular guide member 100 formed of three panels 102, 104 and 106 is shown positioned elevationally below the series of openings 80A. This guide member 100 is adapted to direct articles dislodged from the various openings 80 and 80A to the opening 94 defined in the substrate 26. Guide member 100 may be omitted from certain embodiments of the invention. The fourth substrate also defines a laterally extending, angled ramp 110 on each side of the opening 94. Each of the ramps 110 on its lowermost end connects to a laterally extending, horizontally positioned shelf 117. The shelf 117 is positioned proximate the lower edge of the opening 94. Ramp 110 may be omitted from certain embodiments of the invention.

FIG. 6 illustrates the spatial relationship of the openings 49 of the second substrate, the indicia labeled semi-spherical portions of the third substrate and the voids 80 defined within the fourth substrate 26. As can be noted in FIGS. 9 and 9A, the circular openings 49 align with the circular portion of the recess void 80 while the elongate portion of each opening 80 extends outwardly from the aligned portions of the openings 49 and 80.

Figure 10:
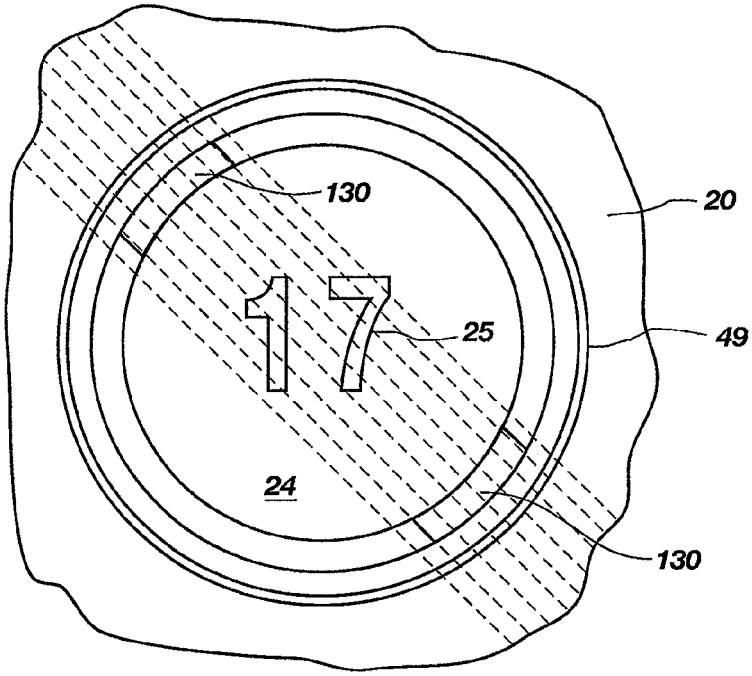
FIG. 10 is a sectional view of the Calendar shown in FIG. 1.
Figure 11:
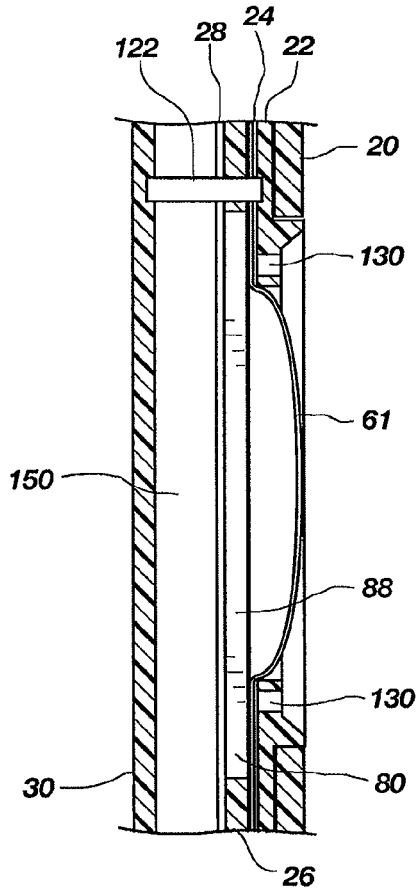
FIG. 11 is a cross-sectional view of the Calendar shown in FIG. 1.

FIGS. 10 and 11 illustrate an embodiment of the invention, wherein a tool is used to dislodge the compacted web 88 from its void 80. In this embodiment, each opening 49 is associated with a means of facilitating the operation of such a tool. As shown in FIGS. 10 and 11, a single opening 49 is associated with its respective semi-spherical portion 61 of substrate 24. The second substrate 22 defines a pair of slot openings 130 positioned diametrically spaced from one another and adjacent to the dome shaped button 61 defined by the substrate 24. These slots 130 extend through the thickness of the second substrate 22 and are configured to permit the user to insert the arms of a tool through the slots and by subsequently pressing the tool against the substrate 24 positioned adjacent the substrate 24 apply a laterally directed force against the substrate 24 sufficient to dislodge rearwardly a message strip 88 positioned within the recess well 80 defined within the fourth substrate 26. In this particular embodiment, the arms of the tool may actually rupture the substrate 24 as they exert a lateral force on the message strip 88. FIG. 10 shows the folded message strip 88 in phantom lines illustrating the positioning of the message strip behind the button 61.

Alternatively, the user may dislodge the message strip 88 from its void 80 by applying a lateral force directly to the message strip 88 by pressing the button portion 61 of the substrate 24 with the user's finger or another object.

Figure 8:
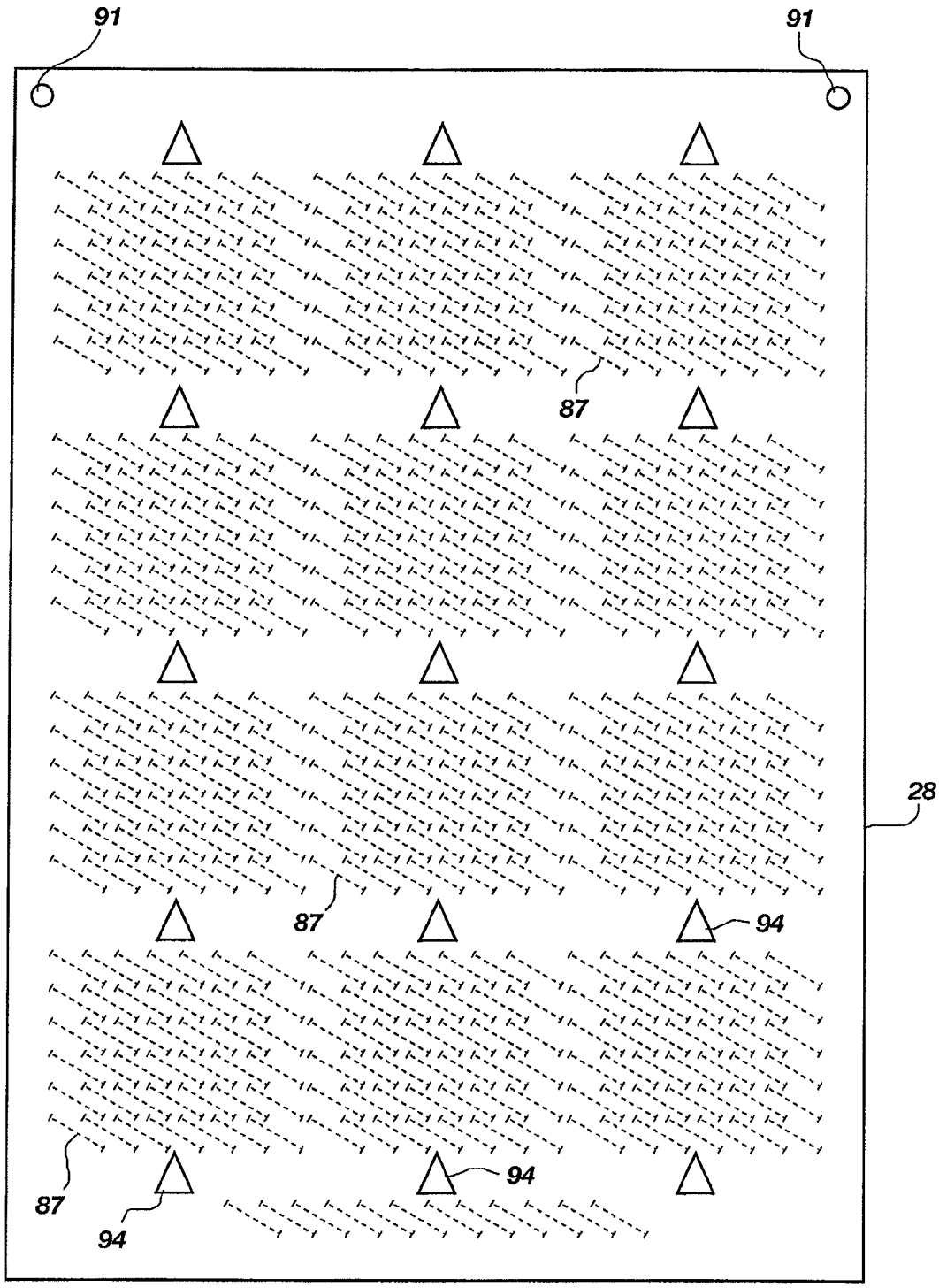
FIG. 8 is a front elevational view of the fifth substrate shown in FIG. 1.

The fifth substrate 28 is secured to the rear face of the fourth substrate 26 and defines a series of triangular openings therein dimensioned to permit the passage there through of the guide members 116 and 100. Further, in preferred constructions, the substrate 28 includes a plurality of perforation or score marks 87. These perforation marks are configured to be parallel to the longitudinal axis of the message strip 88 when the strip is in its folded condition. The perforation marks 87 and the longitudinal axis of the strip 88 are positioned to align in parallel with the longitudinal axis 84 of each of the openings 80 in the fourth substrate 26 when the fourth substrate 28 is secured to the rear surface of the fifth substrate and the message strip is positioned within its respective cavity. In a preferred construction the perforation marks 87 are constructed to include a principal longitudinally positioned perforation mark in association with a pair of perpendicularly oriented perforation marks, one perpendicularly oriented perforation mark being positioned on each of the opposing ends of the principal perforation mark as shown to advantage in FIG. 8. The fifth substrate 28 also defines openings 91 proximate the corners thereof dimensioned to receive the spacer elements 60.

The sixth substrate 30 is formed of a rectangular panel having a front planar surface 93. This substrate 30 defines a plurality of receiving wells 95, positioned proximate the corners of the substrate 30 adapted to receive and retain the spacer elements 60. The spacer elements 60 function to position the front surface 93 spacedly from the rear surface of the fifth substrate 28 thereby defining a plenum 150 between the fifth and sixth substrates. This plenum 150 defines a passageway for articles that are displaced from their retaining cavities 80 and through the fifth substrate by the user.

Figure 13:
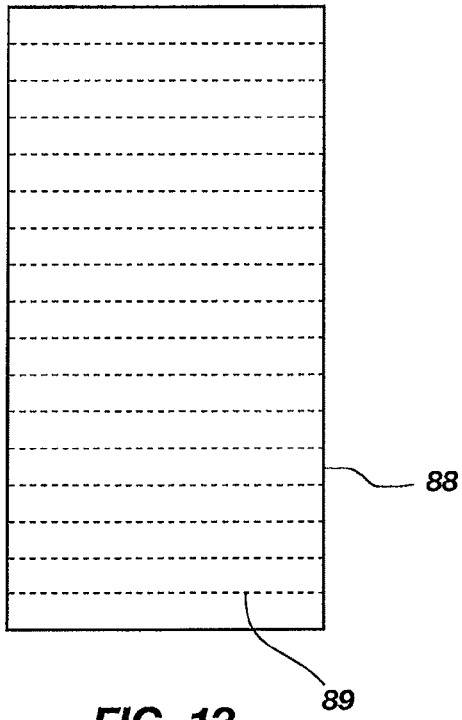
FIG. 13 is a plan view of a message strip.
Figure 14:
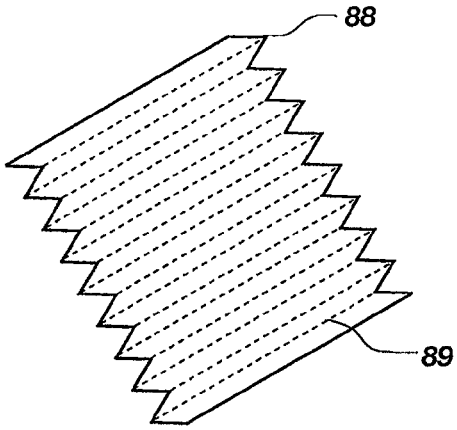
FIG. 14 is a perspective view of the message strip of FIG. 13 shown in a partially folded configuration.

FIGS. 11 and 12 illustrate a side sectional view of the calendar assembly that shows the plenum 150. FIGS. 13 and 14 illustrate a first embodiment of a message strip or web 88 that is configured to be housed within the cavity 80 of substrate 26. As shown, the message strip 88 may include a rectangular sheet of paper that is perforated, scored or otherwise adapted to permit the folding of the strip along lines that are generally perpendicular to the longitudinal axis of the strip to thereby form the accordion configuration shown in FIG. 14. The folded strip may thereafter be further processed to form a generally boxlike element having a rectangular cross-section that may then be positioned within a respective cavity 80 defined within the substrate 26.

Figure 13A:
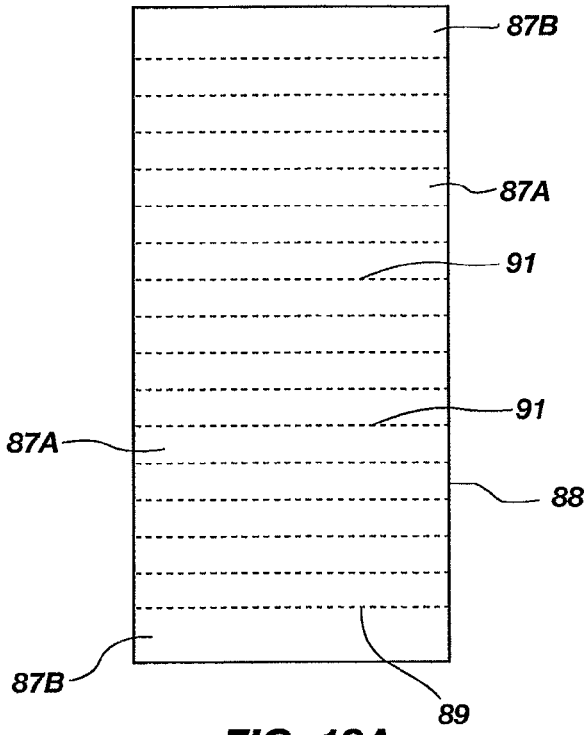
FIG. 13A is a plan view of an alternative embodiment of a message strip.
Figure 14A:
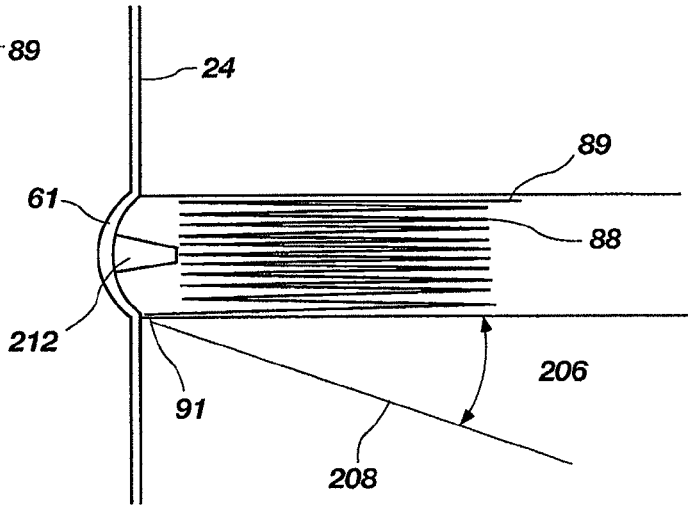
FIG. 14A is a cross sectional view of a dispensing assembly with the message strip being disposed with the folds oriented generally horizontally.

FIGS. 13A and 14A illustrate an alternative construction of a message strip 88 wherein a rectangular strip of paper is perforated or scored to form a plurality of substantially similar rectangular shaped panels 87A. The first and second panels 87B are dimensionally larger in width than the panels 87A. When the message strip 88 is folded along the perforated or scored lines 91 in an accordion like fashion, the message strip is formed into the construction shown in FIG. 14A. It should be understood that the message strip 88 may be positioned within the cavity 80 in a number of orientations. For example, the message strip 88 may be positioned in the orientation shown in FIG. 14A within the cavities 80. This particular positioning can lead to a significant reduction in the required thickness of the calendar. In some embodiments the thickness has been reduced from one quarter inch to one eighth of an inch by adopting this particular orientation of the message strip 88. In FIG. 14A the panels 87A are arranged to be substantially horizontal in orientation. In other embodiments, the panels are oriented substantially vertically. Notably, in FIG. 14A the panels 87B, which are positioned as the first and the last panels of the message strip, due to their larger width, extend outwardly from the remainder of the panels to form tabs 89 and 91 as shown in FIG. 14A. These tabs 89 and 91 may be grasped by the user in order to assist the user in unfolding the message strip 88 so that its contents may be read.

Figure 15:
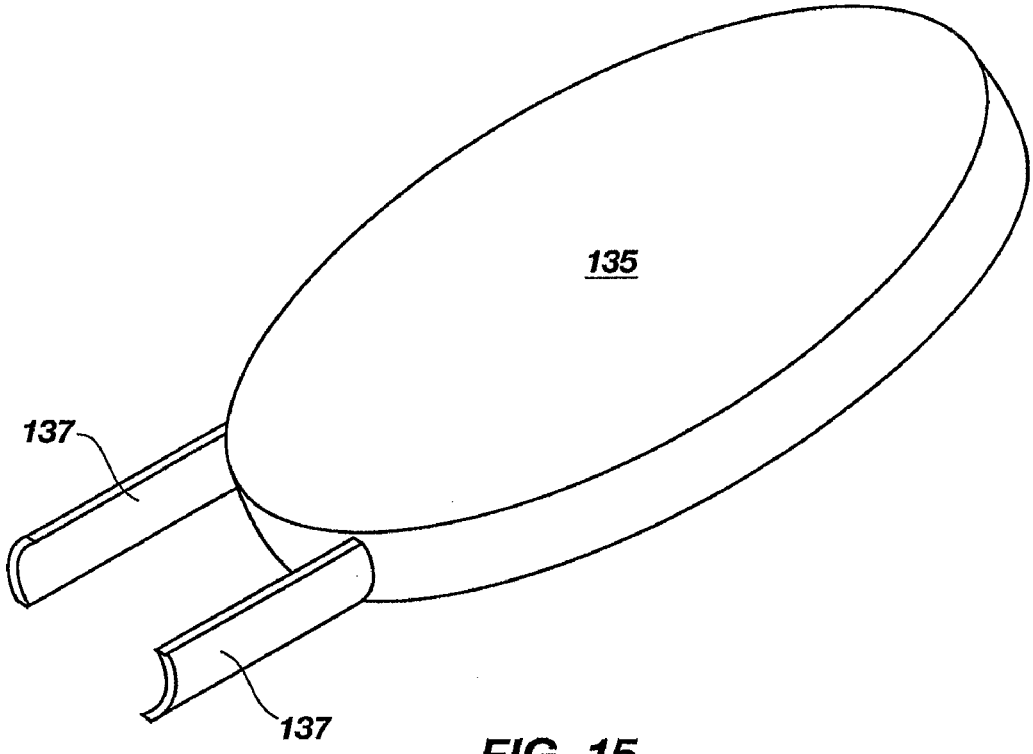
FIG. 15 is a perspective view of an apparatus for dislodging the paper rolls from their respective retaining channels in the calendar assembly of FIG. 1.
Figure 16:
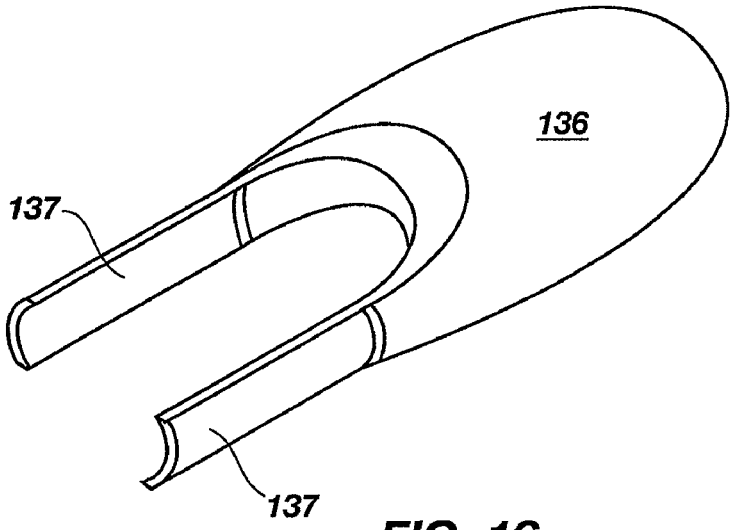
FIG. 16 is a perspective view of an alternative apparatus for dislodging the paper rolls.

FIGS. 15 and 16 illustrate two dislodgement tools that may be utilized by the user to dislodge the articles 88 from the recess wells 80. As shown, each tool includes a pair of outwardly extending, parallel radiating arms 137 that are dimensioned to be received within the slots 130. The arms 137 are fixedly connected to a handle section 135, 136 that is graspable by the user.

It should be noted that in the instant calendar construction, the use of dislodgement tools whose operative arms are received in preformed slots 130, permits the use of the calendar without actually destroying the portion 61 of substrate 24 that extends through openings 46 and 49. It follows that the aesthetic appearance of the calendar is not altered as the month progresses and the individual articles are dispensed from the calendar. Furthermore, in those embodiments of the calendar wherein the operation of the calendar is activated by the user pushing directly on the portion 61 of the substrate, the portion 61 is likewise not ruptured or otherwise damaged, thereby preserving the aesthetics of the calendar's appearance. Furthermore, in some of the versions of the calendar in which the user directly pushes the portion 61, the need for a fourth and fifth substrate 28 may be eliminated by adhering the message strips 88 directly on the back of the third substrate 24 by means of a weak adhesive.

FIG. 17 is a perspective view of an alternative construction of the calendar wherein a single month is shown as opposed to an arrangement of twelve months. The calendar is shown within a frame or cabinet 172 having a cap section 174 that covers the upper region of the frame. The cap section 174 may be configured to be manually removable from the frame for purposes of permitting the user to change the individual calendar element that is displayed in the frame. The frame 172 is supported in an upright position through the assistance of a support 176, which is mounted on the rear portion of the frame 172.

Figure 18:
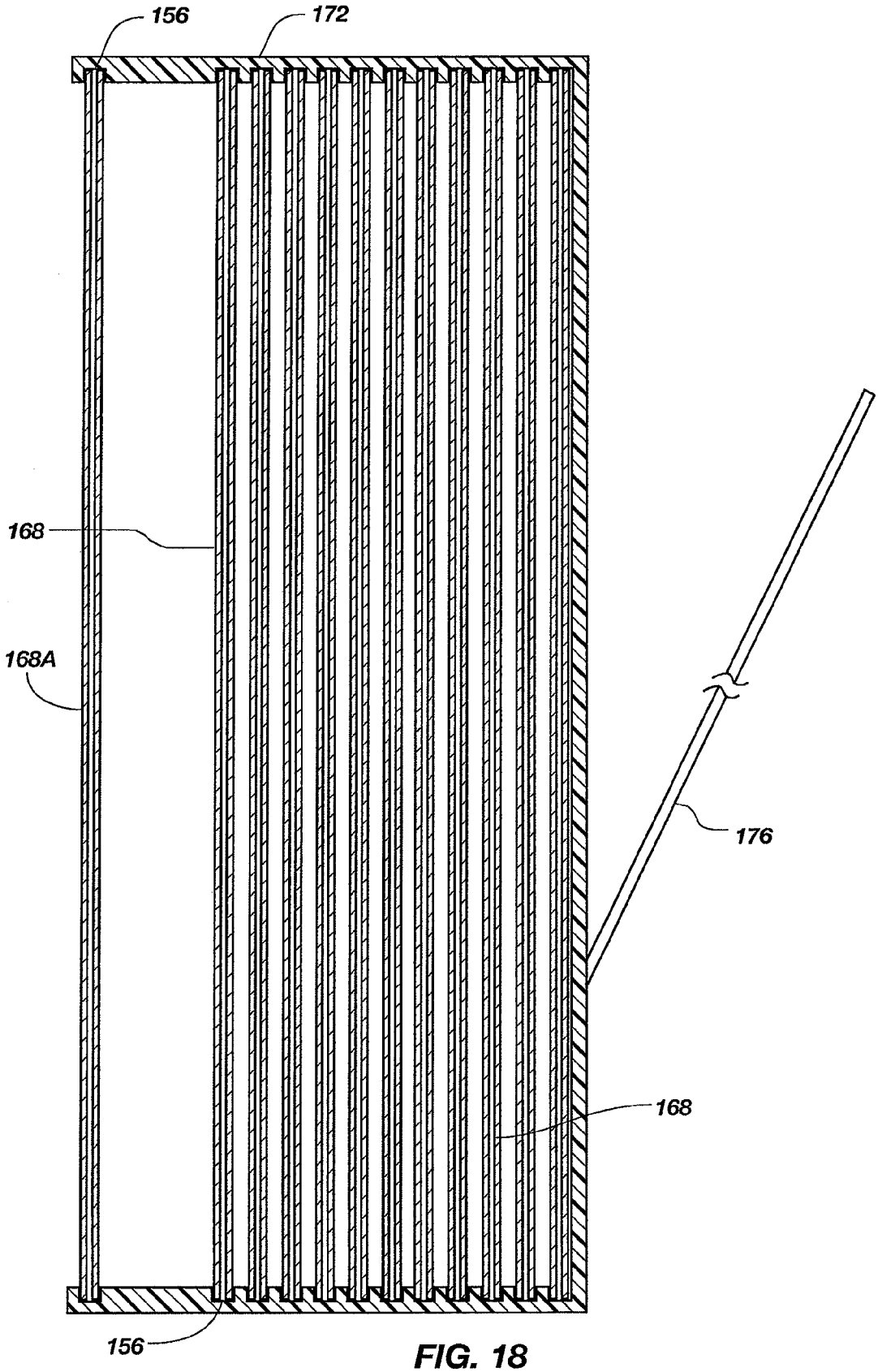
FIG. 18 is a top view of the calendar assembly of FIG. 17 with the top of the cabinet being removed.

FIG. 18 is a top view of the calendar assembly of FIG. 17, with the top of the cabinet frame being removed, which illustrates the placement of the various calendar elements 168. Each of these elements 168 are retained within a pair of slots 156 defined within the internal sidewalls of the frame 172. As shown, each of the elements 168 extend between a respective pair of slots 156 and is retained thereby within the frame. The interior of the frame 172 may be accessed by removing the cap section 174 whereby, the user may simply pull the foremost calendar element 168A upward until it is disengaged from its respective pair of slots 156. Thereafter, the user may retrieve another calendar element 168 from the collection of remaining elements 168 housed within the frame and subsequently position this second calendar element in the position previously occupied by the foremost calendar element 168A. Each of the calendar elements 168 shown in FIG. 18 is formed from an assembly of substrates 20, 22, 24, 26 and 28. It is contemplated that substrates 26 and 28 may also be omitted from certain embodiments of the invention, for instance, in those embodiments which utilize a weak adhesive to secure the compressed web to the back of the substrate 24.

The embodiment of FIGS. 17 and 18 provides several practical benefits among which is the opportunity to provide the user with monthly or quarterly calendar elements 168 for insertion into the calendar cabinet structure. This permits the calendar supplier to provide up to date information printed on the articles to be dispensed. It follows that this embodiment constitutes a significant marketing opportunity and value for the calendar supplier.

Figure 19:
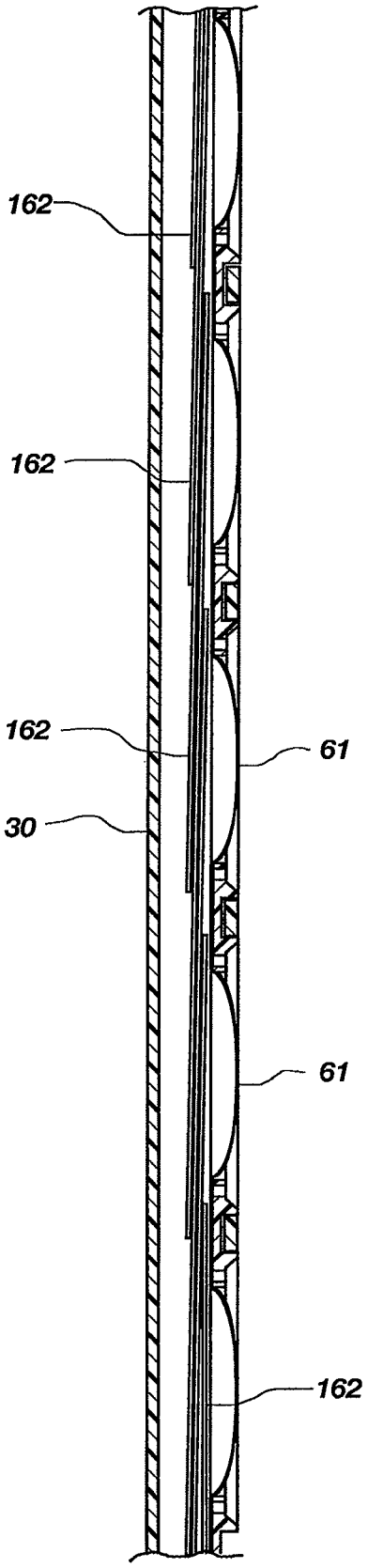
FIG. 19 is a cross sectional side view of an alternative embodiment of the calendar of FIG. 1.
Figure 20:
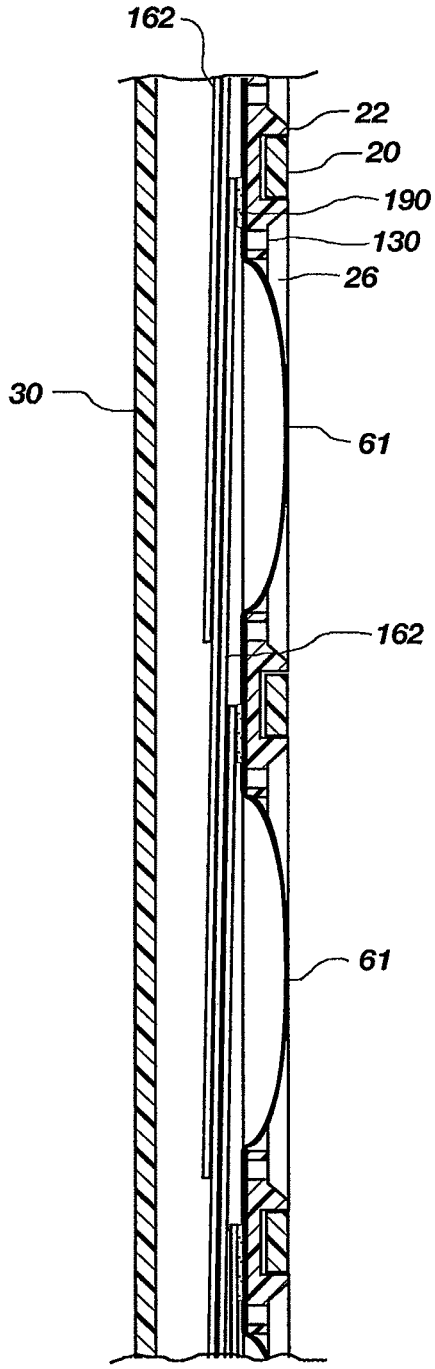
FIG. 20 is a cross sectional side view of the alternative embodiment of the calendar of FIG. 1 as shown in FIG. 19.
Figure 21:
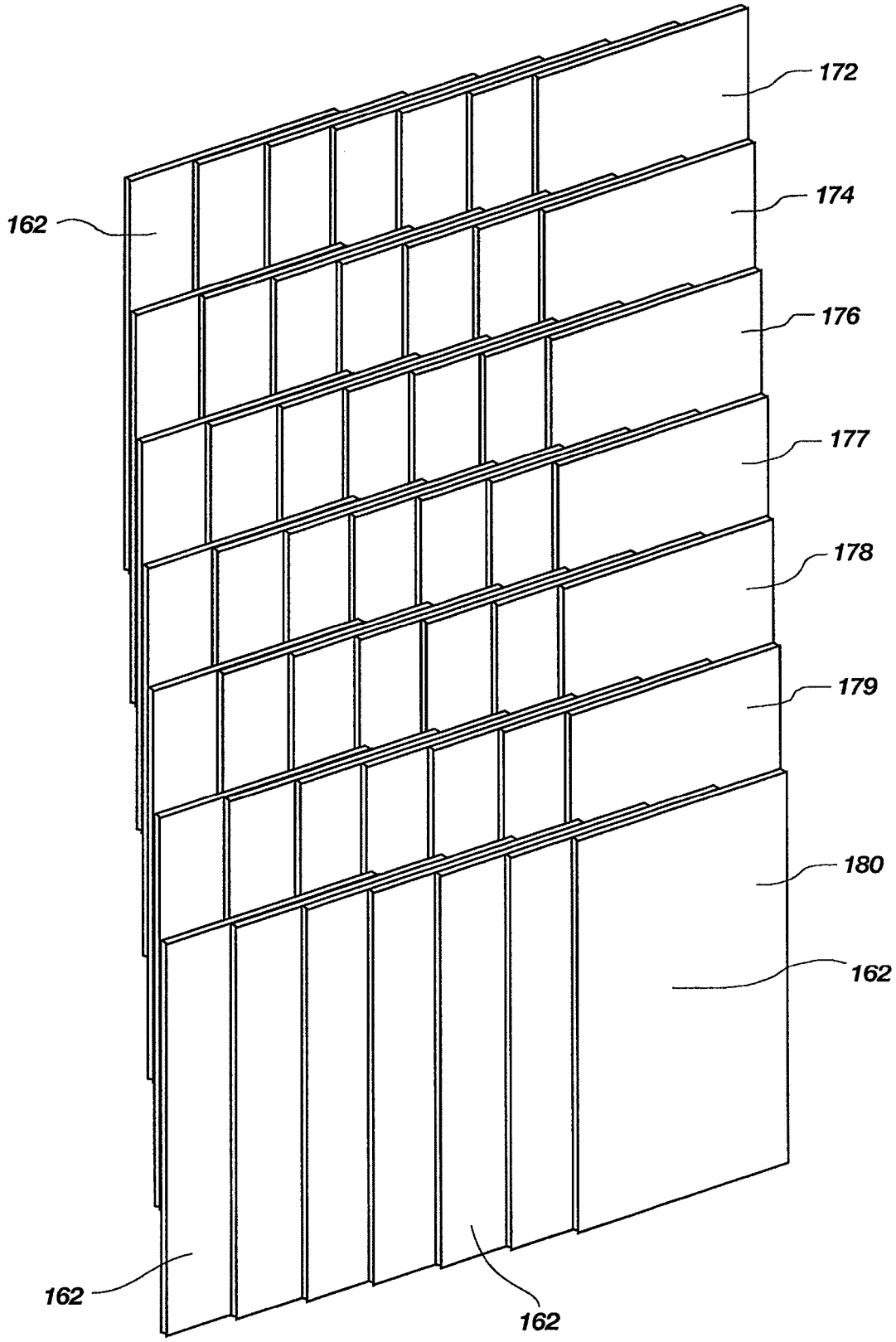
FIG. 21 is a perspective view of a collection of message strips from the calendar shown in FIG. 19.

FIGS. 19 through 21 illustrate an alternative construction of the calendar wherein the fourth and fifth substrates are replaced by a construction wherein a series of planar message panels 162 are selectively adhered to the rear surface of the third substrate 24. Each panel 162 is adhered to the third substrate proximate the perimeter of a respective opening 49 with a weak adhesive such that upon the passage of the arms 137 through the slots 130 the respective panel is disengaged from the third substrate 26 to thereafter fall downward to the collection opening 48 through the plenum 150. A shown in FIG. 21, the panels 162 are arranged in vertical rows as well as horizontal rows. Each panel is overlapped by an adjacent panel proceeding from right to left along each horizontal row as shown in FIG. 21. Furthermore, each panel 162 is overlapped by an adjacent panel 162 proceeding from the bottom of the panel assembly to the top of the assembly along each vertical row, as also shown in FIG. 21. The overlapping of the adjacent panels is further illustrated in FIGS. 19 and 20 in an overlapped orientation.

Figure 22:
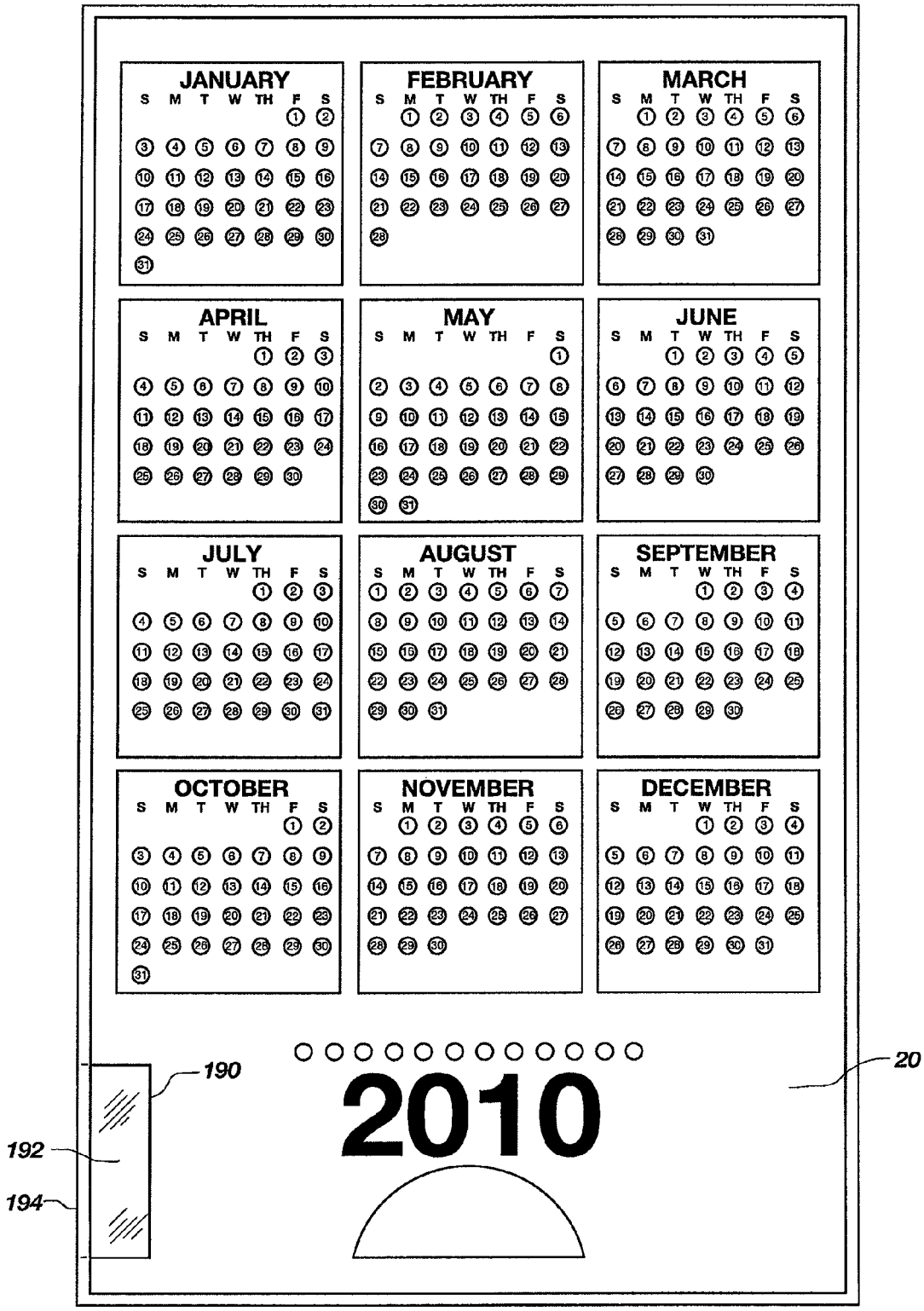
FIG. 22 is a front view of another embodiment of the invention.

FIG. 22 illustrates a further embodiment of the invention, wherein the foremost substrate of the calendar is fitted with a decoder 190. The decoder includes a colored transparent panel, which may be fabricated of plastic. In this embodiment, the substrate 20 and 22 are configured to define a void that is positioned directly behind the plastic panel 192. The void is configured to receive and retain an article 88 that is inserted therein. This void is accessible through a vertical slot 194 that is defined within the frame 172. In this embodiment, the article 88 may be imprinted with a message or other indicia that is decipherable by positioning it within the void such that the user may observe the article through the plastic panel 192. The message or other indicia may be imprinted or otherwise applied to the article 88 utilizing one of many inks or other writing mediums whose appearance only becomes visible to the human eye when it is observed through a specially colored transparent panel 192. Such technology is disclosed in the game DOUBLE TALK by Boyle & Elggren, Inc.

Figure 23:
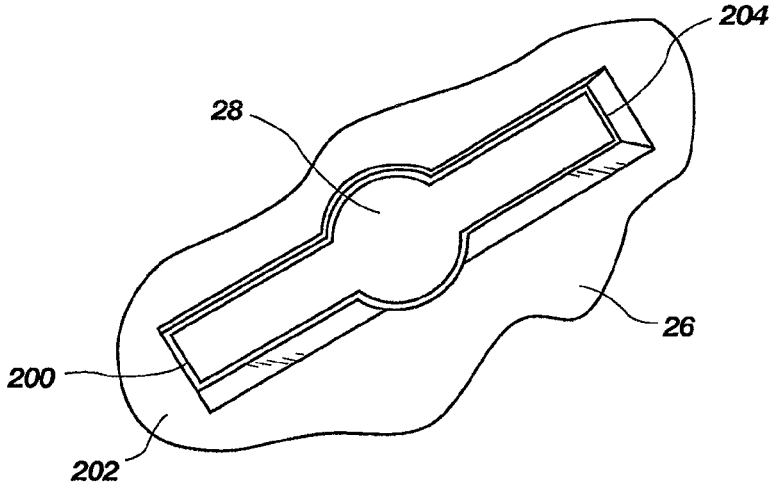
FIG. 23 is a perspective sectional front view of an alternative message retaining cavity element of the invention.
Figure 23A:
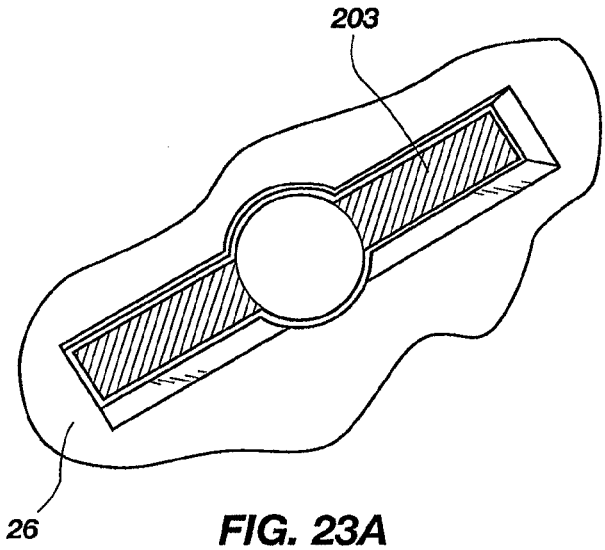
FIG. 23A is a perspective sectional front view of an alternative message retaining cavity element wherein the structure of the element has been reinforced.
Figure 24:
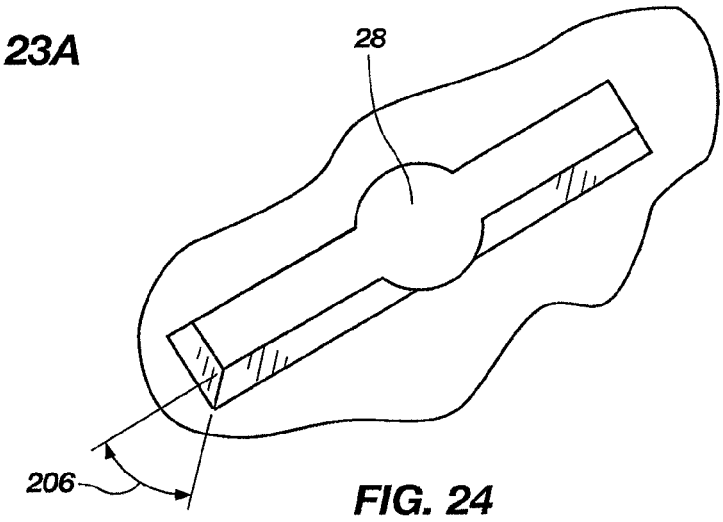
FIG. 24 is a perspective sectional rear view of the message retaining cavity element of FIG. 23.

FIGS. 23 and 24 illustrate an alternative embodiment of the layer 26. In contrast to the construction shown in FIGS. 9A and 9B wherein the cavities 28 are formed by generally planar sidewalls and wherein each sidewall is positioned substantially parallel to the sidewall which is positioned opposite thereto, the embodiment of FIGS. 23 and 24 defines a cavity structure wherein the longitudinally oriented sidewalls although planar are not positioned parallel to one another. As illustrated, the end sidewall 200 extends outwardly generally perpendicularly from the plane 202 of the layer 26. In contrast, the opposing end sidewall 204 is oriented at an angle of between 20 degrees and 80 degrees from the horizontal i.e. from the plane of the layer 26; as shown by arrow 206. In preferred constructions, the angle is within the range of 20 degrees and 60 degrees. Similarly, the longitudinal sidewall 208 is oriented approximately perpendicularly to the plane of the layer 26 while the opposing longitudinal sidewall 210 is oriented at an angle of approximately 120 degrees from the plane of the layer 26. As shown to advantage in FIG. 27, the orientation of the sidewall 208 provides an inclined or chamfered sidewall which may assist in the displacement of a message strip 88 which has been dislodged from its location within the cavity formed by the association of sidewalls. In preferred constructions, the message strip is releasably retained within the cavity by means of an adhesive which initially secures the strip 88 to a structural element within the cavity. Once the adhesive bond has been broken by an application of a disruptive force to the message strip, the strip is displaced onto the surface of the sidewall 208. Due to its inclined orientation, the message strip slides along the surface of the sidewall 208 eventually sliding off of the surface of the sidewall 208 and into the plenum formed between layer 26 and layer 30. FIG. 23A illustrates a construction wherein the cavity forming structures of substrate 26 have been reinforced by forming material 203 to cover over the two lateral wings of the cavity, shown here by hatching, thereby leaving only the central circular opening in an open condition. This construction may be useful where the substrate 26 is formed from a material having less rigidity.

Figure 25:
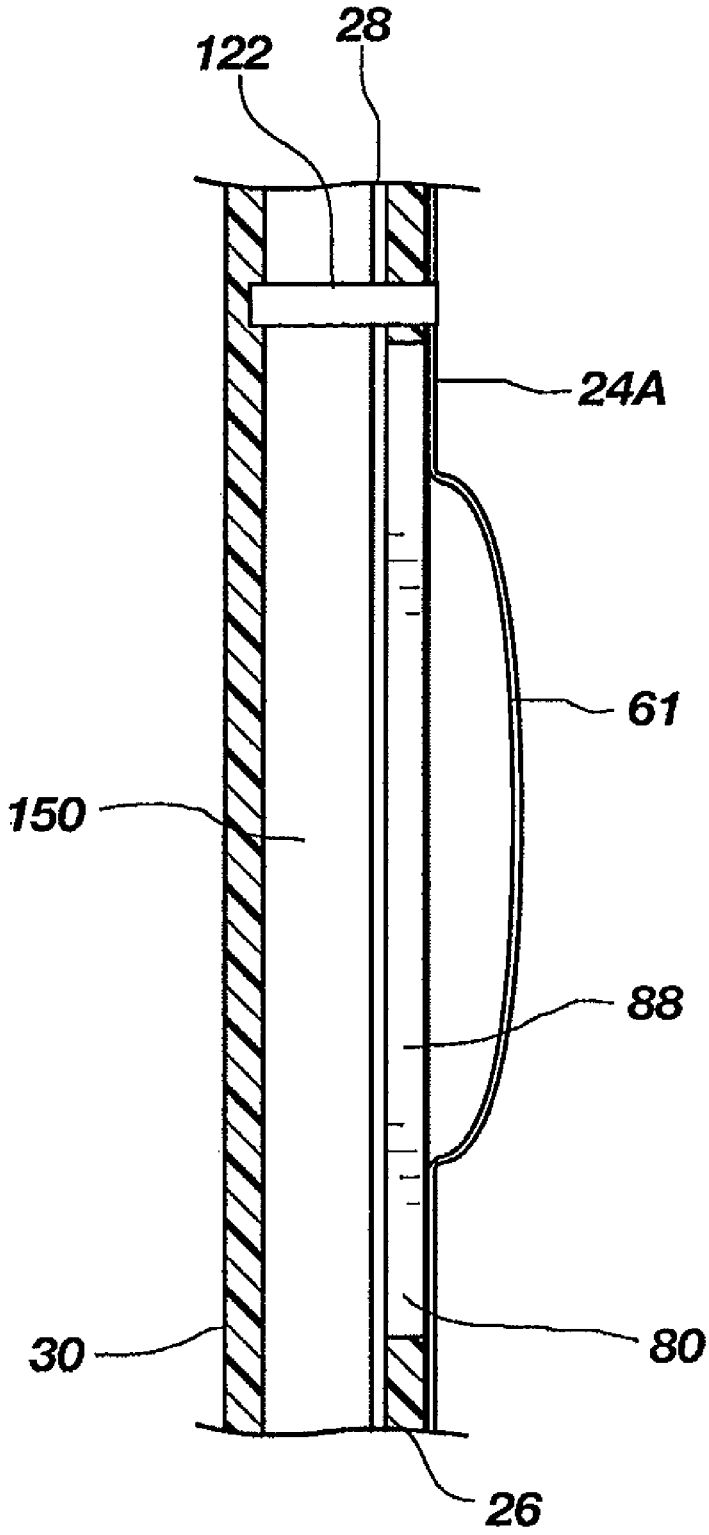
FIG. 25 is a cross sectional view of an alternative activation construction of the invention.

FIG. 25 defines an alternative activation assembly construction wherein the layers 20, 22 and 24 of the calendar structure are consolidated into a single layer 24A which defines a button element 61. The button 61 directly communicates with the cavity housing and may directly contact the message strip 88 such that upon a depression of the button 61, the message strip 88 is dislodged from the cavity through the layer 28 and into the plenum 150.

In the embodiment of FIG. 25 the substrate 24A may be fabricated from plastic, rubber, plastic with a rubber coating or rubber or plastic with a vacuum metalized coating. The choice of material may be dictated by the desired operational appearance of the calendar. In those embodiments where a button construction is desired which clearly shows that a button has been previously activated or depressed, the plastic button may be chosen in that once depressed the plastic button 61 may tend to remain depressed clearly indicating that it has been activated. Rubber buttons, in contrast, tend to return to their unactivated configuration after the user releases a depressing force on the button. It follows that this choice of button material may be used when the user desires to have a calendar configuration wherein the buttons do not signal whether they have been previously activated, i.e. depressed. Rubber coated plastic buttons may tend to stay in their depressed condition. Metalized buttons may also tend to indicate that they have been activated once they are depressed.

Figure 26:
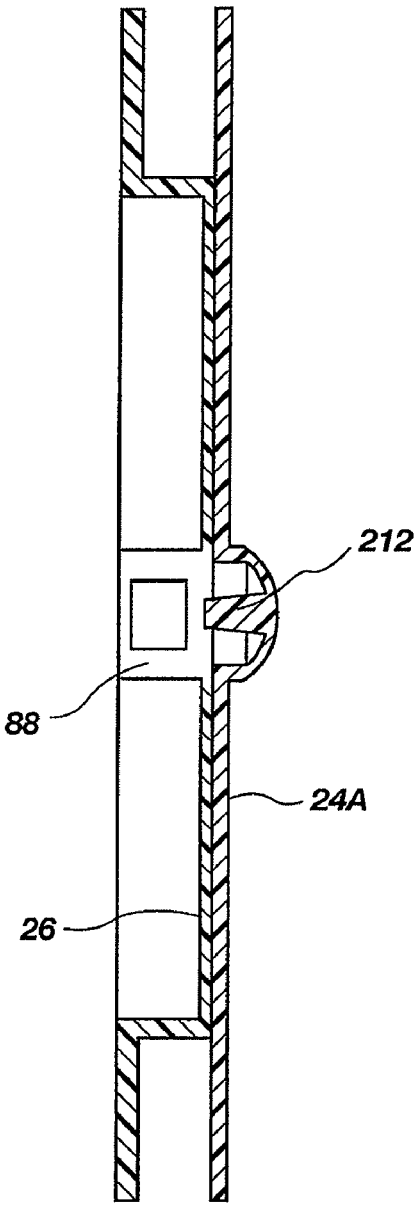
FIG. 26 is a cross sectional view of a further alternative embodiment of an activation assembly of the invention.
Figure 27:
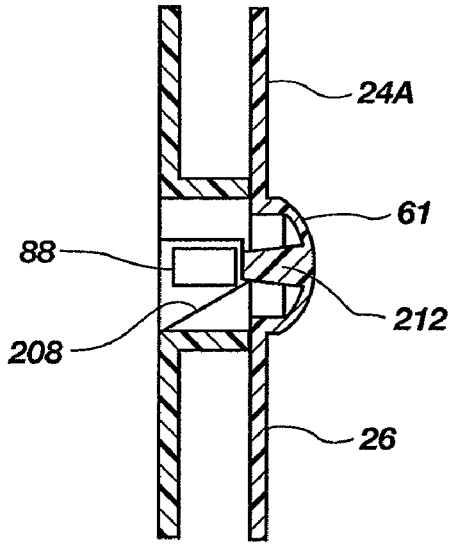
FIG. 27 is a cross sectional view of yet another alternative embodiment of an activation assembly of the invention.

FIG. 26 illustrates an alternative construction wherein the button 61 is fitted with a projection element 212 which is secured to the internal sidewall of the button 61. The projection 212 is positioned adjacent to the message strip 88 such that upon any depression of the button 61, the projection 212 immediately engages the message strip and functions to displace the message strip outwardly away from the button 61 and toward the plenum 150. It follows that the embodiment of FIG. 26 avoids the need for the button 61 to be depressed a significant distance before it actually engages the message strip and initiates a displacement of the message strip toward the plenum 150. FIG. 27 illustrates an alternative construction wherein the projection fitted button 61 is coupled with a cavity which defines an inclined sidewall 208 of the type described above with reference to FIGS. 23 and 24.

Figure 28:
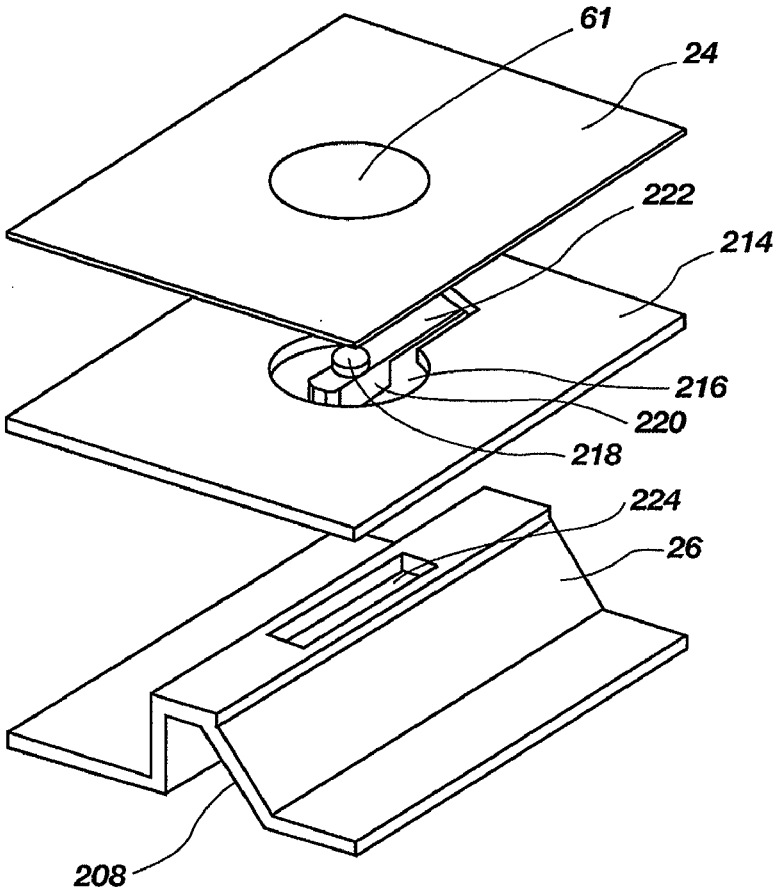
FIG. 28 is an exploded view of another activation assembly of the invention.
Figure 29:
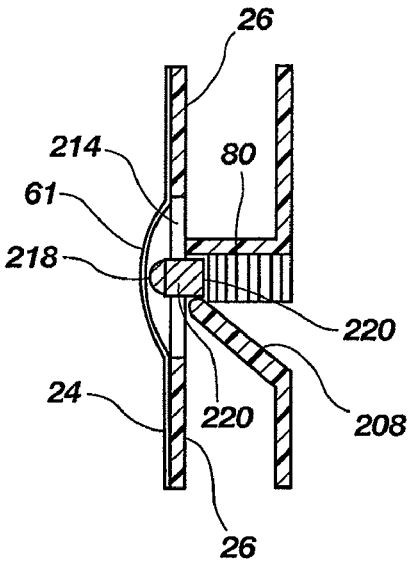
FIG. 29 is a cross sectional view of the activation assembly of FIG. 28.
Figure 29A:
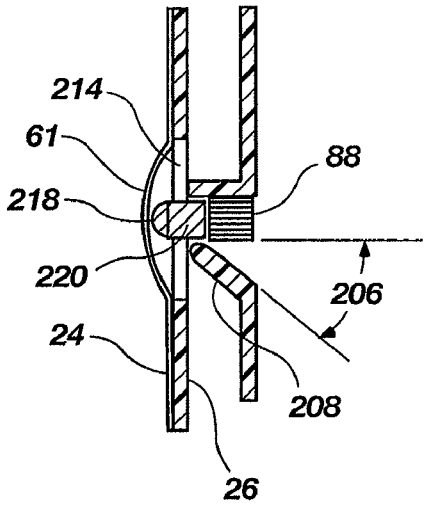
FIG. 29A is a cross sectional view of a dispensing assembly similar to the dispensing assembly of FIG. 29 in which the message strip is positioned with the folds oriented generally horizontally.

FIGS. 28 and 29 illustrate an alternative activation assembly which includes a substrate 214 which is positioned intermediate the substrate 24 and the substrate 26. As shown the substrate 214 defines an opening 216 which extends through the thickness of the substrate. Positioned within the opening 216 is an upwardly extending projection 218 which engages on its upper end with the interior surface of the button 61 defined within substrate 24. The bottom of the projection 218 is coupled with a driving element 220 which is designed to engage the message strip 88 residing within the cavity 80 defined within the substrate 26. The projection 218 and the driving element 218 are coupled to a support arm 222 which is coupled at its opposing end to the substrate 214. The support arm's coupling to the substrate 214 is sufficiently flexible such that the free end of the support arm 222 may pivot about that coupling to thereby permit the projection 218 and the driving element 220 to be displaced upward and downward responsive to a depression of the button 61. An aperture 224 is defined within the substrate 26. This aperture is dimensioned to permit the driving element 220 to pass through the substrate 26 and thereafter engage the message strip 88 which is positioned within the cavity 80 defined within the substrate 26. Alternatively, the arm 222 may be fabricated from a material having sufficiently flexibility to permit the upward and downward displacement of the projection 218 and the driving element 220.

Figure 30A:
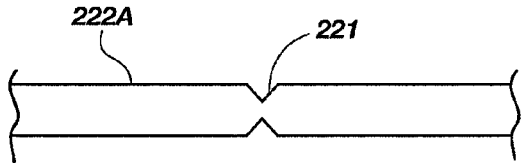
FIG. 30A is a partial side view of a support arm as shown in FIG. 30.
Figure 30:
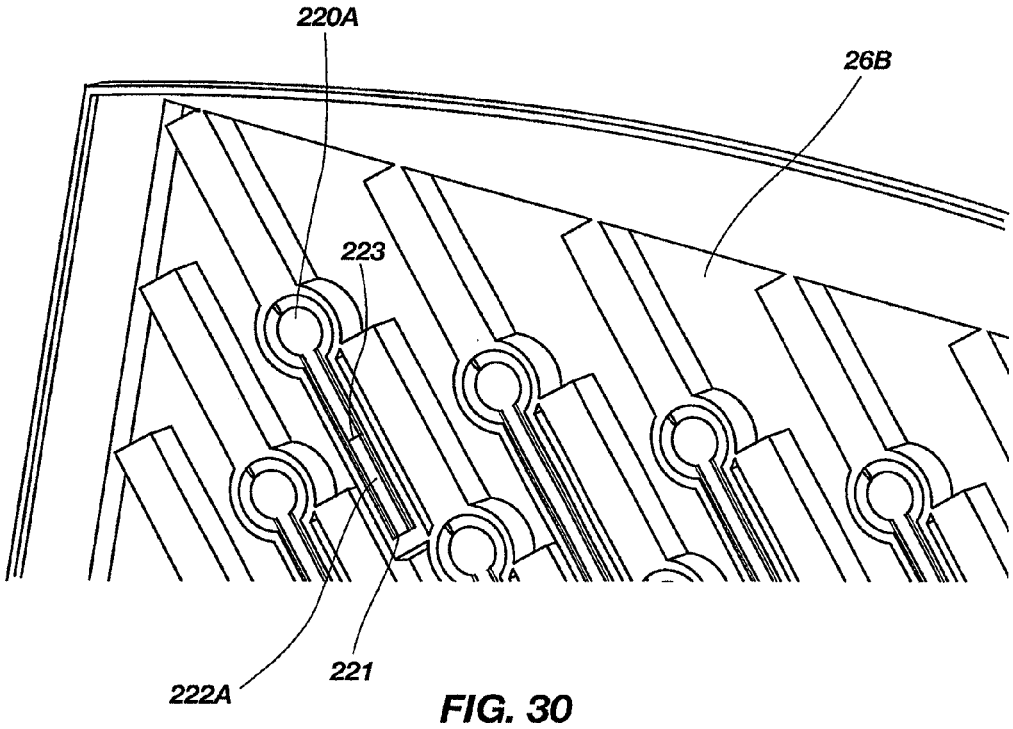
FIG. 30 is a partial sectional plan view of a cavity defining substrate.
Figure 31:
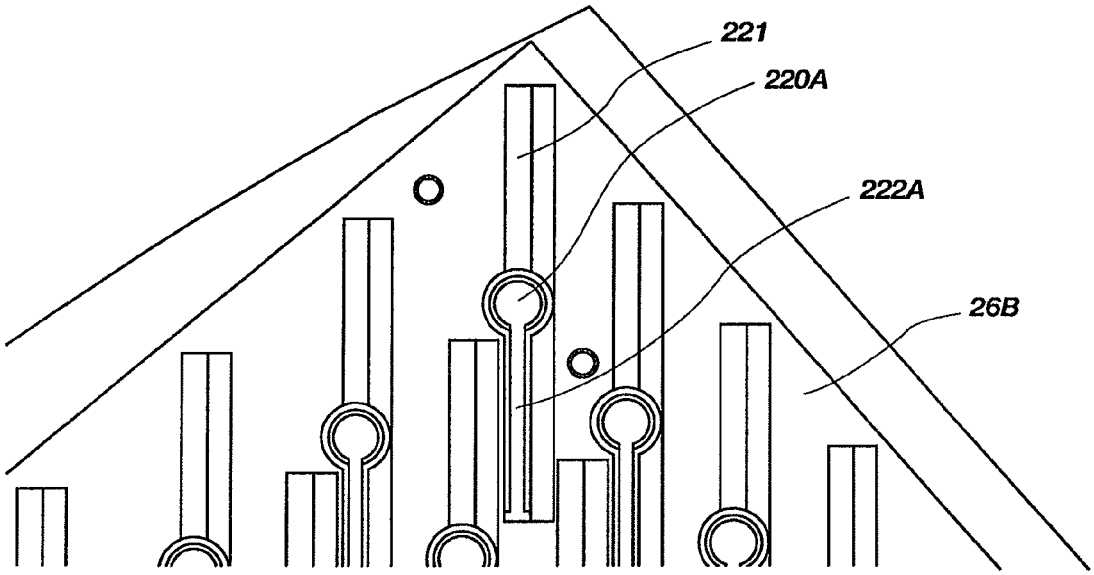
FIG. 31 is a partial sectional plan view of the cavity defining substrate of FIG. 30.
Figure 32:
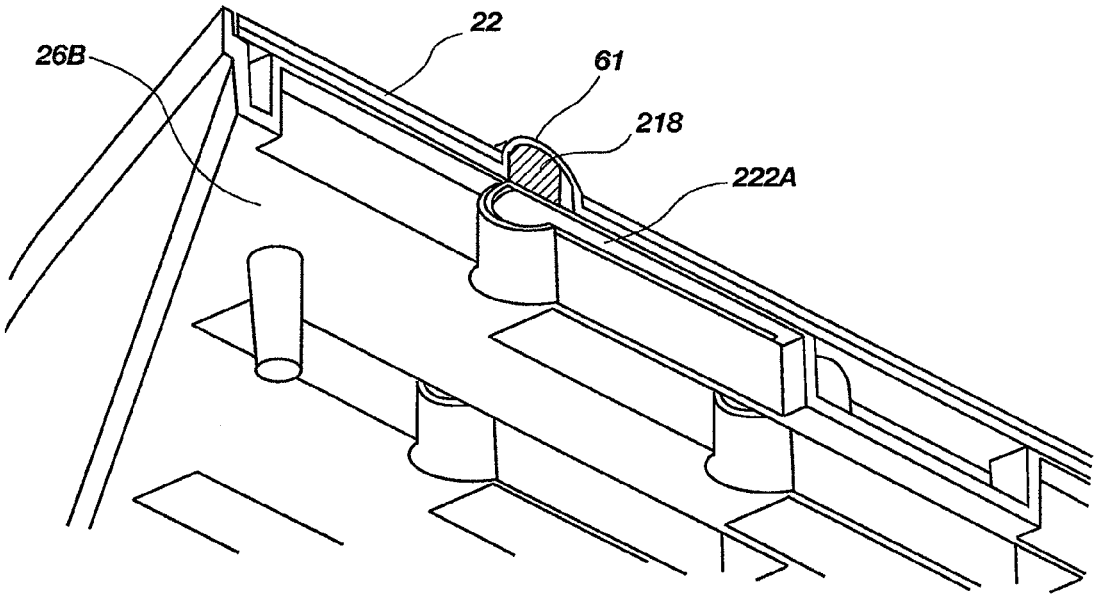
FIG. 32 is a partial perspective view of the cavity defining substrate of FIG. 30.
Figure 33:
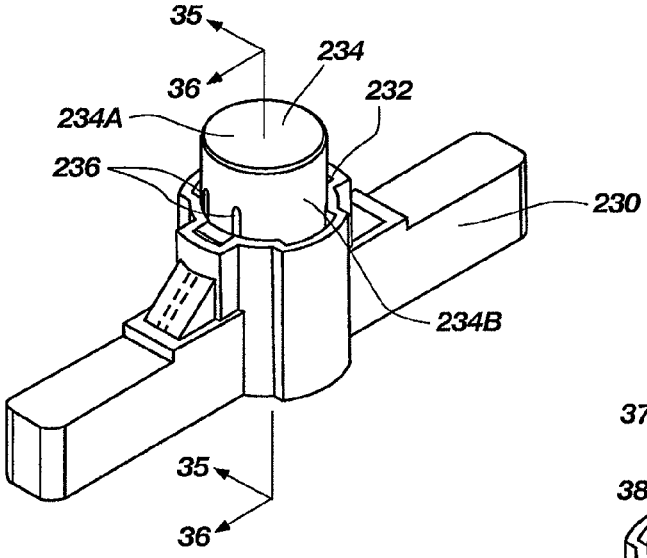
FIG. 33 is a perspective view of a further activation assembly of the invention shown in an un-activated condition.

FIG. 30-32 illustrate an alternative embodiment of the activation assembly of FIGS. 28-29. In this embodiment the substrate 214 is consolidated with substrate 26, the driving element 220A and its associated arm 222A is positioned within an opening 224A. The arm 222A is physically attached to the substrate 26B. In some embodiments the arm 222A may be integral with the substrate 26B with a hinge element 221 interposed between the arm 222A and the remainder of the substrate 26B. This hinge element is shown to advantage in FIG. 30A. As shown in FIG. 30 a second hinge element 223 may also be incorporated into the structure of the arm 222A. In those embodiments wherein the arm 222A is intended to operate only once during the life of the calendar, the hinge 223 operates to retain the arm 222A in a depressed condition once the arm has initially been depressed.

FIGS. 33-40 illustrate yet a further activation assembly for use within the instant invention. As shown a housing 230 defines a central opening 231 in which a button element 234 is displaceably disposed. The central opening 231 as shown to advantage in FIGS. 36 and 37 includes a pair of laterally extending openings 233A which are positioned opposite from one another about the axis 239. The central opening 231 also includes a second pair of laterally extending openings 233B which are positioned opposite from one another about the axis 239. The button 234 includes a central cylindrically shaped element together with a pair of laterally extending elements 239 positioned opposite one another about the central cylindrically shaped element. A second pair of laterally extending elements 241 are positioned opposite from one another about the central cylindrically element. Each of the elements 239 is sized and configured to be slideably received within a respective opening 233A. Each of the elements 241 is sized and configured to be slideably received within a respective opening 233B. The positioning of the elements 239 and 241 within their respective openings functions to restrict any rotation of the central button 234 about its axis 237 and restrict the motion of the central button to a displacement parallel to the axis 237.

The button 234 includes a somewhat curved portion 234A in association with a hollow cylindrical element 234B which extends outwardly from the curved portion 234A. The element 234B defines a number of slots 236 therein which function to divide the element 234B into a number of elongate members 243 which extend parallel to the axis 237. The placement of the slots 236 further operate to permit these members to flexible contract inwardly toward axis 237 and expand outwardly from the axis 237.

Positioned on the interior sidewall 243 of the housing 230 which defines the central opening 231 is a pair of outwardly extending projections 242. Each of these projections 242 extends into a respective opening 233B. The hollow cylindrical element 234B defines two recesses 244, each of these recesses 244 is configured and positioned to slidably receive a respective projection 242 when the button 234 is oriented to position that respective projection in abutment with its respective recess. Owing to the slots 236 and the resilient nature of the material from which the button 234 is fabricated, the members 243 tend to urge the recesses 244 into engagement with the projections 242 whereby each of the projections is displaceably received within a respective recesses 244. The unactivated condition of the button 234 as shown in FIGS. 30, 32, 33 and 36 illustrates the projections 242 retained within their respective recesses 244. Upon the application of a force in the direction indicated by arrow 249, each of the elements 234B is forced downwardly. Due to the presence of the projections 242 these elements 234B are also forced inwardly toward the axis 237 such that upon sufficient downward displacement of the element 234B, the element 234B is forced sufficiently inwardly toward axis 237 that each of the two recesses 244 is withdrawn from engagement with its respective projection 242. As the force is continued to be applied in the direction of arrow 249, the central button 234 is displaced in the direction of arrow 249 until it reaches the orientation shown in FIG. 34. The button 234 also includes a pair of guides 248 which are dimensioned to be received in slots 250 defined within the structure 248. The interaction of the guides 248 in the slots 250 operates to restrict any rotation of the button 234.

Figure 34:
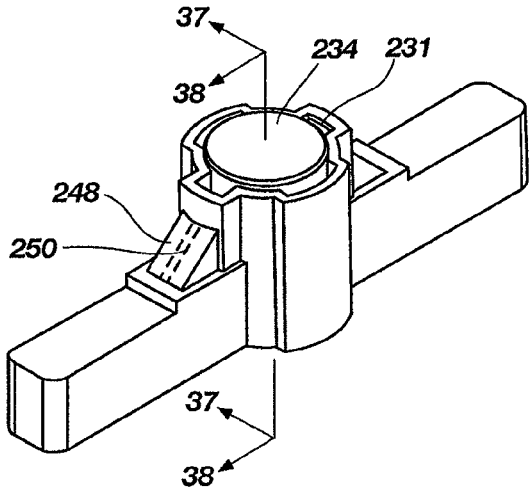
FIG. 34 is a perspective view of the activation assembly of FIG. 33 shown in an activated condition.
Figure 35:
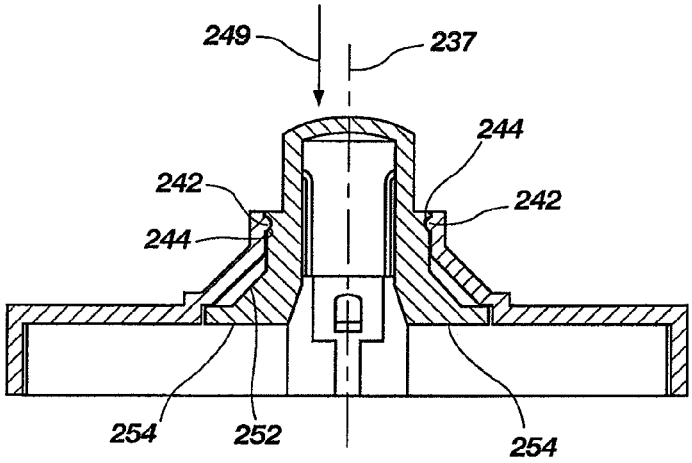
FIG. 35 is a cross sectional view of the activation assembly of FIG. 33 taken along section lines 35-35.
Figure 36:
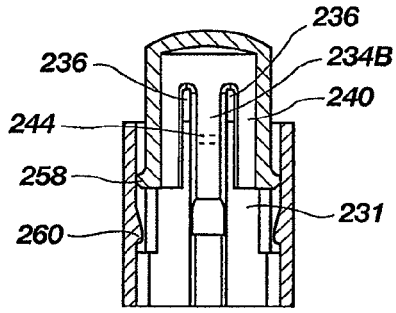
FIG. 36 is a cross sectional view of the activation assembly of FIG. 33 taken along sectional lines 36-36.
Figure 37:
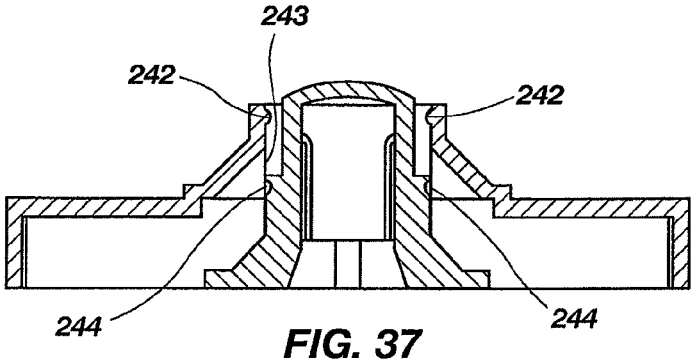
FIG. 37 is a cross sectional view of the activation assembly of FIG. 34 taken along sectional lines 37-37.
Figure 38:
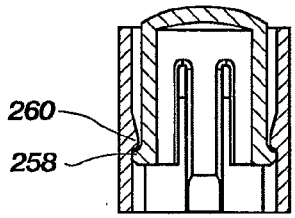
FIG. 38 is a cross sectional view of the activation assembly of FIG. 34 taken along sectional lines 38-38.
Figure 39:
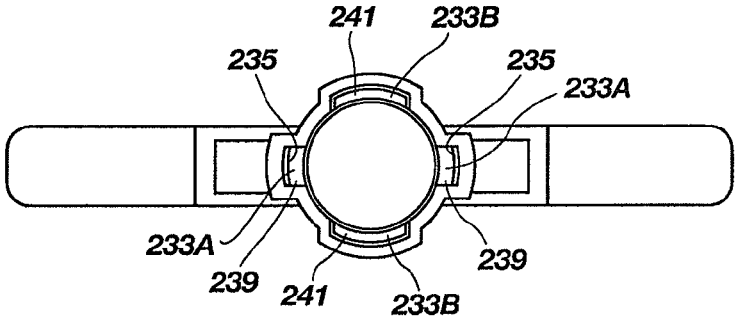
FIG. 39 is a top plan view of the activation assembly of FIG. 33.
Figure 40:
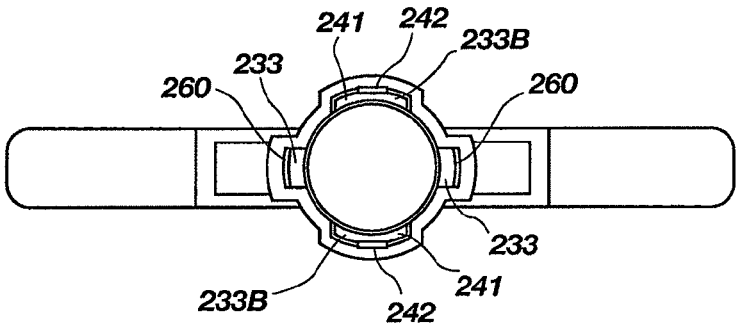
FIG. 40 is a top plan view of the activation assembly of FIG. 34.

In the condition shown in FIG. 34, a projection 258 formed on the exterior surface of an element 234A engages an outwardly projection 260 formed on the interior sidewall 243 of the housing 230. As the button 234 is forced downwardly, the element 234A is resiliently forced inwardly toward axis 237 due to the engagement of the projection 258 against the projection 260. Once the element 234A is forced sufficiently downwardly that the projection 258 is elevationally below the projection 260, the resiliency in the material forming the element 234A causes the projection 258 to be urged outwardly thereby forming a latching of the button 234 with the sidewall 243 which inhibits, and possibly precludes, any upward displacement of the button 234 within the opening 232.

Figure 42:
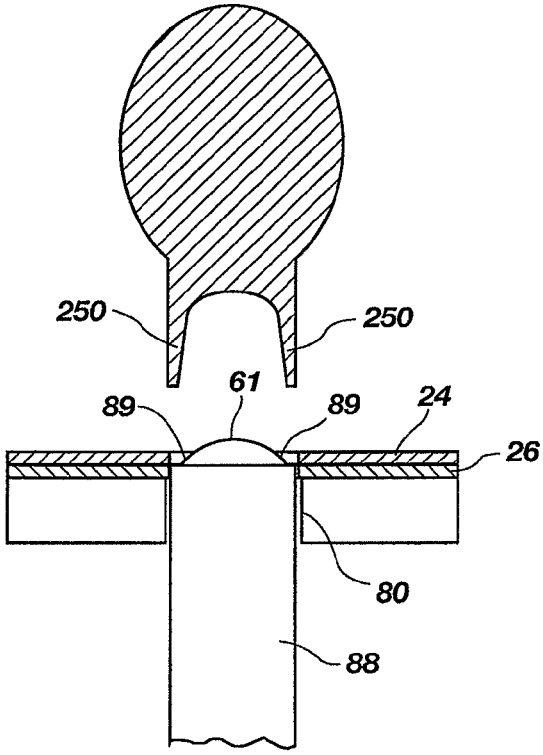
FIG. 42 is an exploded sectional view of the calendar and key element of FIG. 41.
Figure 41:
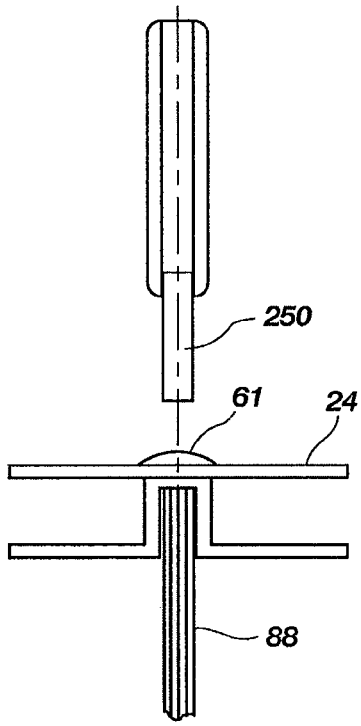
FIG. 41 is a side view of a section of a calendar of the invention in association with a key element.

FIGS. 41 and 42 illustrate en embodiment wherein a key element is utilized to dislodge the article 88 from its cavity within a substrate 26. In this embodiment the substrate 24 defines two slots 89 which are positioned such that when the prongs 250 of the key element are inserted through the slots 89, the prongs engage with the message strip 88 and apply a force to the article sufficient to dislodge it from its cavity. As illustrated the message strip 88 may be positioned such that its longitudinal axis is oriented perpendicular to the front surface of the calendar in contrast to the other embodiments of this invention wherein the longitudinal axis of the message strip is oriented parallel to the front surface of the calendar.

Operation

In operation, as each time period, e.g., a day, occurs, a user of the calendar may use the dispensing tool by inserting the arms 137 of that tool through the slots 130 of the calendar. As the arms either enter the recess well 80 by passing through the substrate 24, the arms engage an information carrying article, e.g., a message strip 88, positioned within that recess well 80. By applying sufficient force to the tool the article 88 is pushed through the respective perforated region of the fifth substrate 28. The article 88 is thereby displaced outward from the rear surface of the fifth substrate into the plenum 150. The article 88 thereafter falls downward through plenum 150 under the force of gravity. The falling article 88 is directed by guide elements 100 and ramp 110 to the opening 48 where it may be retrieved by the user.

In those embodiments that do not utilize a dispensing tool for their operation, the user may press on the semicircular cross-sectioned portion 61 of the substrate 24 that extends outward through the opening formed by openings 46 and 49, which corresponds to the selected day. As pressure is applied to the portion 61, force is applied to the message 88 sufficient to displace it rearwardly and outwardly through the substrate 28. Thereafter, the message 88 passes into the plenum 150 and subsequently to the opening 48. In those constructions which consolidate the substrates 20 and 22 into substrate 24, the user simply depresses the button 61.

In the other embodiments of the invention which utilize alternative activation assemblies, the user activates the activation assembly to effect a discharge of the article, e.g. the message strip from its cavity. Typically, such an activation requires the user to push on the activation assembly.

While the above description contains many specific details as to construction of the invention, it should be appreciated that the invention is subject to many modifications, and is therefore, accordingly the full and true scope of the invention should be determined only by the appended claims and their legal equivalents.

What is claimed is:

1. A Calendar comprising:

a primary substrate having a front surface and a rear surface, said front surface defining a plurality of indicia, said primary substrate having a plurality of activation assemblies, each said activation assembly being associated with a respective said indicia;

a secondary substrate positioned proximate said primary substrate, said secondary substrate defining a plurality of elongate cavities therein, each said cavity having a longitudinal axis oriented parallel to a front surface of said second substrate, a plurality of articles, each said article having a longitudinal axis associated therewith, each said article being positioned within a respective said elongate cavity, wherein the longitudinal axis of said article is oriented parallel to said longitudinal axis of said elongate cavity; and a collection chamber disposed adjacent said secondary substrate for receiving at least one said article subsequent to the displacement of said article from an elongate cavity upon an application of a laterally directed force on said article by said activation assembly.

2. The Calendar of claim 1, wherein at least one said articles includes information disposed on a surface thereof.

3. The Calendar of claim 1, wherein said longitudinal axis of said elongate cavity is oriented at an angle between substantially 5 degrees and substantially 85 degrees from the horizontal.

4. The Calendar of claim 1, further comprising a securement substrate positioned intermediate said secondary substrate and said collection chamber, said securement substrate being configured to retain said articles from being dislodged outwardly from the rear face of said secondary substrate.

5. The Calendar of claim 1, further comprising a retaining substrate positioned intermediate said first substrate and said secondary substrate, said retaining substrate being configured to retain said articles from being dislodged outwardly from the front face of said secondary substrate.

6. The Calendar of claim 1, wherein at least one of said activation assemblies is configured to communicate a force applied thereto to one of said articles housed within a respective said cavity sufficiently to dislodge said one article from said respective cavity.

7. The Calendar of claim 1, wherein said collection chamber comprises a rear substrate spacedly positioned from said secondary substrate to form a channel there between dimensioned for passage there through of said articles dislodged from said cavities.

8. The Calendar of claim 1, wherein further comprising a tertiary substrate positioned intermediate said secondary substrate and said collection chamber for releaseably retaining said articles within said respective cavities.

9. The Calendar of claim 8, wherein said tertiary substrate is fabricated from a rupturable material.

10. The Calendar of claim 1, wherein said activation assembly further comprises a flexible button, displaceable by a force applied thereto to engage a respective said article residing within a respective said cavity.

11. The Calendar of claim 10, wherein said flexible button includes a projection on an interior surface thereof which abuts against said article when said button is in an nonactivated condition.

12. The Calendar of claim 10, wherein said button includes a latching structure for releaseably securing said button in an non-activated condition until a force of a predetermined magnitude is applied thereto.

13. The Calendar of claim 12 further comprising a second latching structure for retaining said button in an activated condition.

14. The Calendar of claim 12 wherein said activation device further comprises a pivoted driving structure positioned proximate said button, said driving structure being positioned intermediate said button and said article for transmitting a force applied to said button to said article.

15. The Calendar of claim 1 wherein said cavity defines at least one sidewall which is oriented to define a downwardly inclined pathway for said article during its dislodgement from said cavity.

16. The Calendar of claim 1 wherein said article is releasably secured to said activation device by an adhesive.

17. A method of assembling a calendar comprising:

providing a first substrate defining a plurality of openings through a thickness thereof corresponding in arrangement to days of calendar months, said openings being covered by a flexible membrane;

positioning a second substrate adjacent to a rear surface of said first substrate, said second substrate defining a plurality of cavities therein dimensioned to receive articles therein, a longitudinal axis of each cavity being oriented parallel to a front surface of said second substrate;

placing articles, each article having a respective longitudinal axis, within a respective cavity such that the longitudinal axis of each article is oriented parallel to the longitudinal axis of its respective cavity; and positioning a securement structure about said cavities to displaceably retain said articles within their respective cavities.

18. The Calendar according to claim 1 wherein said primary substrate defines a plurality of slots which communicate with at least one said cavity, said calendar further including a key element having prongs dimensioned to pass through said slots to engage an article disposed within said at least one cavity for applying a force to said article sufficient to disengage said article from said cavity.

19. The Calendar of claim 2 wherein said article comprises a message strip which is folded back on itself a plurality of times to form an accordion shaped element, wherein the opposing ends of said message strip define tabs which extend outwardly from said message strip.

* * * * *